US012760994B2

(12) United States Patent
Clark et al.

(10) Patent No.: US 12,760,994 B2
(45) Date of Patent: Oct. 13, 2026

(54) MULTI-LOCK ADJUSTMENT TURRET FOR AN OPTICAL AIMING DEVICE

(71) Applicant: Sig Sauer, Inc., Newington, NH (US)

(72) Inventors: Jason Clark, Beaverton, OR (US); Andreas G. Schäfer, Hohenahr (DE); Joseph T. Fruechtel, Portland, OR (US); Andrew W. York, Portland, OR (US)

(73) Assignee: SIG SAUER, INC., Newington, NH (US)

( * ) Notice: Subject to any disclaimer, the term of this patent is extended or adjusted under 35 U.S.C. 154(b) by 214 days.

(21) Appl. No.: 18/674,748

(22) Filed: May 24, 2024

(65) Prior Publication Data

US 2024/0393082 A1 Nov. 28, 2024

Related U.S. Application Data

(60) Provisional application No. 63/469,181, filed on May 26, 2023.

(51) Int. Cl.
*F41G 1/16* (2006.01)
*F41G 1/12* (2006.01)

(52) U.S. Cl.
CPC *F41G 1/16* (2013.01); *F41G 1/12* (2013.01)

(58) Field of Classification Search
CPC ..... F41G 1/16; F41G 1/12; F41G 1/00; F41G 1/32; F41G 1/38; F41G 1/54; F41G 1/545; F41G 11/00; G02B 23/00; G02B 23/02; G02B 23/10; G02B 23/105; G02B 23/16
USPC .... 359/428, 362, 399; 42/90, 111, 119, 122, 42/124, 125, 126, 130, 135, 136, 137, 42/139
See application file for complete search history.

(56) References Cited

U.S. PATENT DOCUMENTS

| | | | | |
|---|---|---|---|---|
| 8,516,736 | B2 * | 8/2013 | Windauer | F41G 1/40 42/122 |
| 10,578,399 | B2 * | 3/2020 | Crispin | F41G 1/38 |
| 2011/0100152 | A1 | 5/2011 | Huynh | |
| 2017/0328674 | A1 | 11/2017 | VanBecelaere | |
| 2019/0376765 | A1 * | 12/2019 | Hamilton | F41G 1/38 |

OTHER PUBLICATIONS

International Search Report and Written Opinion of the International Searching Authority issued in International Application No. PCT/US2024/031127, mailed Sep. 23, 2024, 12 pages.

* cited by examiner

*Primary Examiner* — Arnel C Lavarias
(74) *Attorney, Agent, or Firm* — Miller Nash LLP

(57) ABSTRACT

A locking adjustment turret coupled to an optic of an aiming device incudes a locking plate having two or more locking holes, a dial configured to rotate about a central axis of the locking adjustment turret when a user applies a rotational force, a locking pin attached to the dial, the locking pin structured to interface with the locking plate and be received within an aligned one of the two or more holes of the locking plate when the locking pin is aligned with the aligned hole to set the locking adjustment turret in a locked position, a biasing spring for biasing the locking pin toward the locking plate, and a lock release carried by dial, the lock release configured to move radially inward when pressed by a user to cause the locking pin to move out of the aligned hole and set the adjustment turret in an unlocked position.

20 Claims, 35 Drawing Sheets

MULTI-LOCK ADJUSTMENT TURRET FOR AN OPTICAL AIMING DEVICE

CROSS-REFERENCE TO RELATED APPLICATIONS

This disclosure claims benefit of U.S. Provisional Application No. 63/469,181, titled "MULTI-LOCK ADJUSTMENT TURRET FOR AN OPTICAL DEVICE," filed on May 26, 2023, the disclosure of which is incorporated herein by reference.

FIELD

This disclosure relates to optical devices, and more particularly, to an adjustable optical device that locks in multiple positions.

BACKGROUND

Adjustment turrets on optical devices such as riflescopes allow a user to modify an angle of the optical components within the riflescope relative to the body of the riflescope itself. Since the riflescope is generally securely mounted to a firearm, adjusting the angle of the optical components within a mounted riflescope allows the user to change the optical axis of the image viewed through the riflescope relative to the firearm. Typically, optical adjustments are made using dials, or turrets, where an elevation turret adjusts the viewing optics along a vertical plane of the firearm and where a windage turret adjusts the optics along a horizontal plane of the firearm. The turrets are respectively coupled to the vertical and horizontal optical adjustments within the riflescope that move the viewing optics relative to the riflescope body in an amount determined by the user based on the amount of turret rotation.

It is convenient for the elevation turret to lock in a set position, where it only moves from its set position after the user has disabled the lock and deliberately rotates the turret. Such a turret lock prevents the turret from rotating, which would change the previously set viewing angle should the turret be inadvertently or unintentionally rotated. Such an unintentional rotation could happen if an unlocked turret of a riflescope was bumped by the user or scraped against an object, such as a tree or shooting bench.

Embodiments of the disclosure describe optical devices having a turret lock that locks in multiple positions.

DETAILED DESCRIPTION

Embodiments of the invention include an optical device, such as a riflescope, that includes a turret that locks in multiple positions, as described in detail below.

Figure 1:
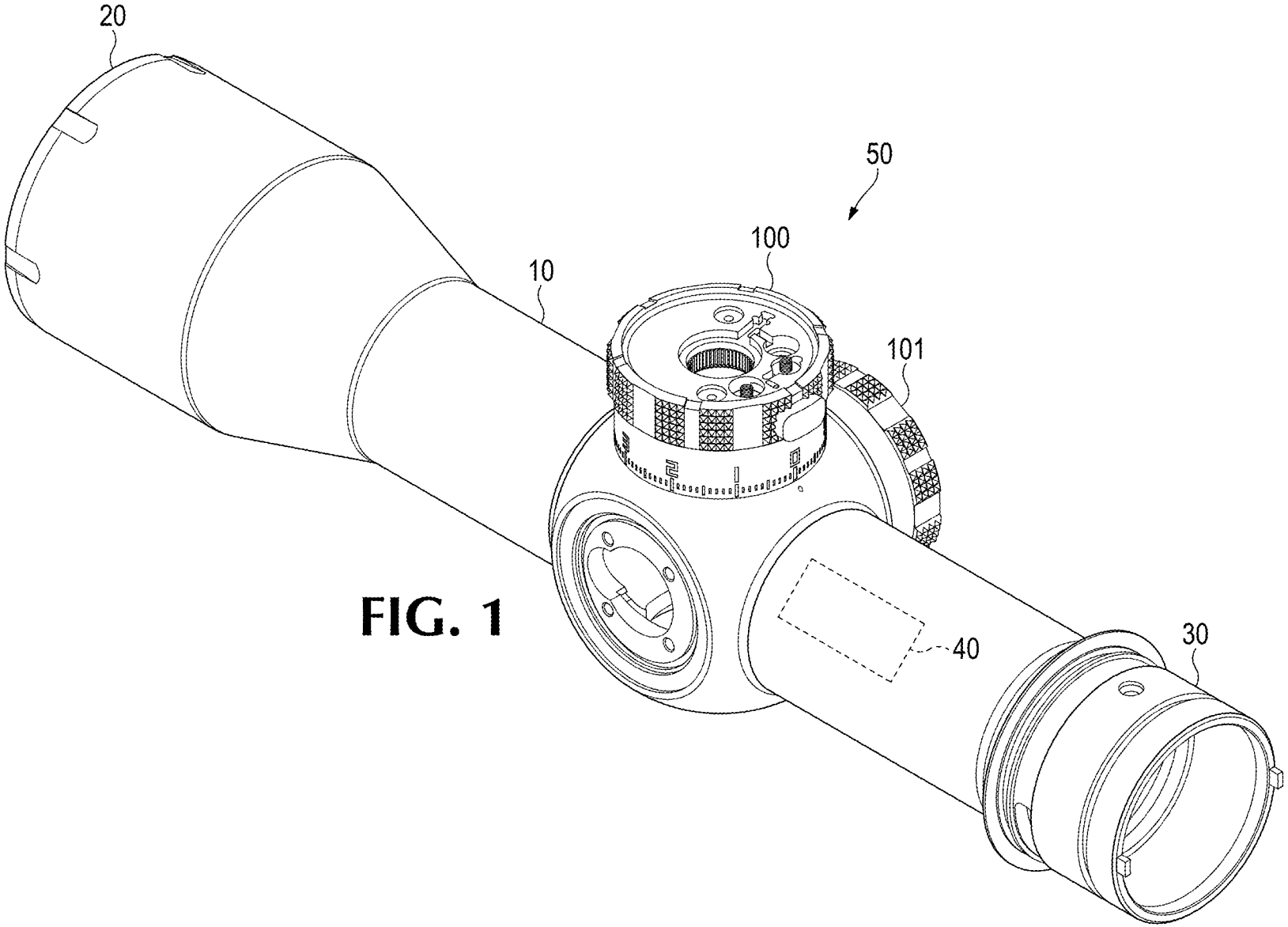
FIG. 1 is a perspective view of a riflescope having an adjustable elevation turret with multiple locking positions, according to embodiments of the disclosure.

FIG. 1 is a perspective view of a riflescope 50 having an adjustable elevation turret 100 with multiple locking positions, according to embodiments of the disclosure. Although the same locking mechanism could be used in conjunction with a windage turret 101, typically windage turrets of riflescopes do not include turret locks because they are adjusted more frequently than elevation turrets. The riflescope 50 has an elongated tubular housing 10 with an enlarged forward portion housing an objective lens 20, and a rear portion housing an eyepiece lens 30. A user views an image of an intended target from the rear of the eyepiece 30. An internal optical element 40 is positioned between the objective and eyepiece lenses, represented in FIG. 1 by an elongated rectangle. In practice the optical element 40 extends through a significant portion of the riflescope 50. The optic element 40 is coupled to the elevation turret 100 as well as the windage turret 101, and the vertical and horizontal alignment of the optical element 40 is controlled by adjustment knobs on the turrets. A user adjusts the knobs of the turrets 100, 101 to cause the image viewed through the riflescope 50 to coincide with a bullet's expected point of impact, with adjustments for bullet drop based on distance, and for windage due to cross winds.

FIGS. 2A, 2B, 2C, 2D, 2E, 2F, and 2G are various perspective views illustrating components of the adjustable elevation turret 100 in a zero, locked position according to embodiments of the disclosure. Some of the components that together produce the locking function of the elevation turret 100 are labeled with number references in FIG. 2A, while other components are occluded in this diagram, and are labeled with number references in other Figures. In general, the elevation turret 100 is illustrated in various operational configurations in FIGS. 2*x*-9*x*, where some components from the elevation turret have been omitted from particular Figures to more particularly illustrate features of operation of the elevation turret.

Generally, the user rotates a dial 104 of the elevation turret 100 to adjust the optics within the riflescope. Neither the optics nor the optics adjustment is illustrated in these Figures as they may be conventional. The elevation turret 100 interfaces with the optics adjustment through a set of splines 106. When the user rotates the dial 104 of the elevation turret, the integrated splines 106, in turn, cause matching splines of the optics adjustment in the riflescope (not illustrated) to rotate, which moves the internal optics by the amount controlled by the user.

A lock 120 performs the main locking function of the elevation turret 100. As best seen in FIG. 2E, the lock 120 is cylindrically shaped and moves in a vertical direction within an aperture 129 as housing shown in FIG. 2A. A lock spring 121 biases the lock in a downward direction, toward a main body of the riflescope 50 (FIG. 1). A lock plate 126 (FIG. 2E) includes three apertures or locking holes 125 at predefined locations (FIG. 2F). Disregarding all of the other components of the lock structure for now, when a lock element, or lock pin 124 of the lock 120 is aligned with one of the locking holes 125 of the lock plate 126, the lock spring 121 urges the lock pin 124 into the aligned hole 125, which locks the elevation turret 100 and prevents it from rotating. As described below, this locking occurs when the elevation turret 100 is at its minimum possible rotation, at its maximum possible rotation, and at an adjustable 'zero' location that is between the minimum and maximum rotations. Conversely, to release the lock 120, and specifically release the lock pin 124 from its locking hole 125, the user presses a lock release 110, which may be in the form of a manually operated button, in an inward direction, toward the center of the elevation turret 100. An inclined plane, or ramp 112, is coupled with or formed as a part of the lock release 110 and engages a matched ramp 128 (illustrated in FIG. 10) on the lock 120 to form a sliding surface. When the lock release 110, and its associated ramp 112, is urged inward, toward the center of the elevation turret 100, the sliding surface formed by the mated ramps 112, 128 translates this horizontal motion of the lock release 110 into vertical motion of the lock 120, causing the lock 120 to move in an upward direction, away from the locking plate 126, and overcome the bias of the lock spring 121. This vertical motion continues until the lock pin 124 is raised completely out of the locking hole. In this unlocked position, the elevation turret 100 may be rotated by the user without engagement of the lock. When the elevation turret 100 is in the unlocked position, the lock release 110 is retained in its inward position to maintain the locking pin 124 in the vertically raised position and out of its corresponding locking hole 125. Extracting the locking pin 124 from its locking hole 125 in the locking plate 126 allows the user to freely rotate the elevation turret 100.

Although embodiments of the locking turret 100 are illustrated and described with the lock pin 124 of the lock 120 as well as the locking holes 125 of the locking plate 126 having circular cross-sectional shapes, any cooperating shape between these elements are possible, so long as their engagement prevents the dial 104 from rotating relative to the locking plate 126 when the locking turret 100 is in any of its locked positions.

Figure 2A:
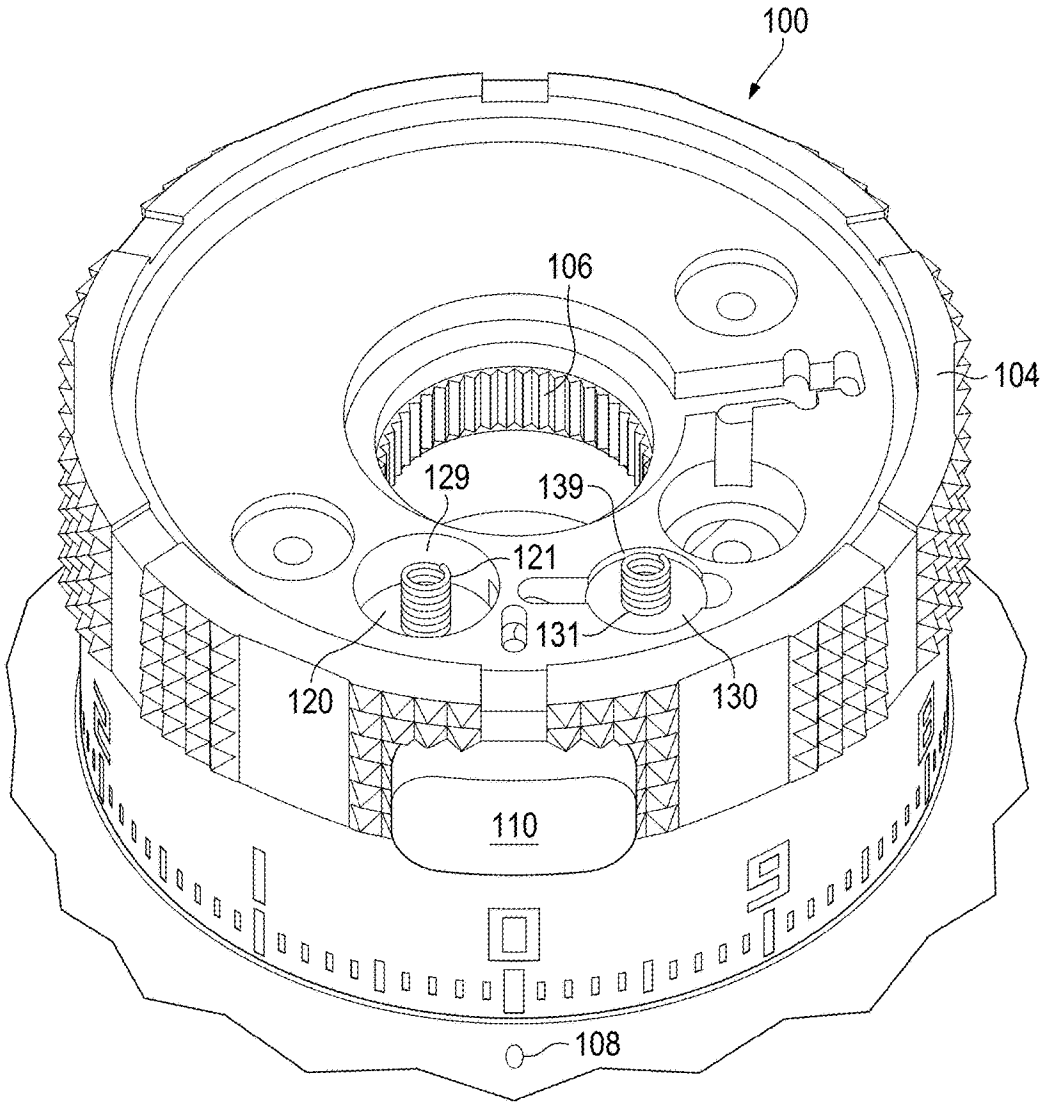
FIGS. 2A, 2B, 2C, 2D, 2E, 2F, and 2G are various perspective views illustrating components of the adjustable elevation turret of FIG. 1 in a zero, locked position according to embodiments of the disclosure.
Figure 2B:
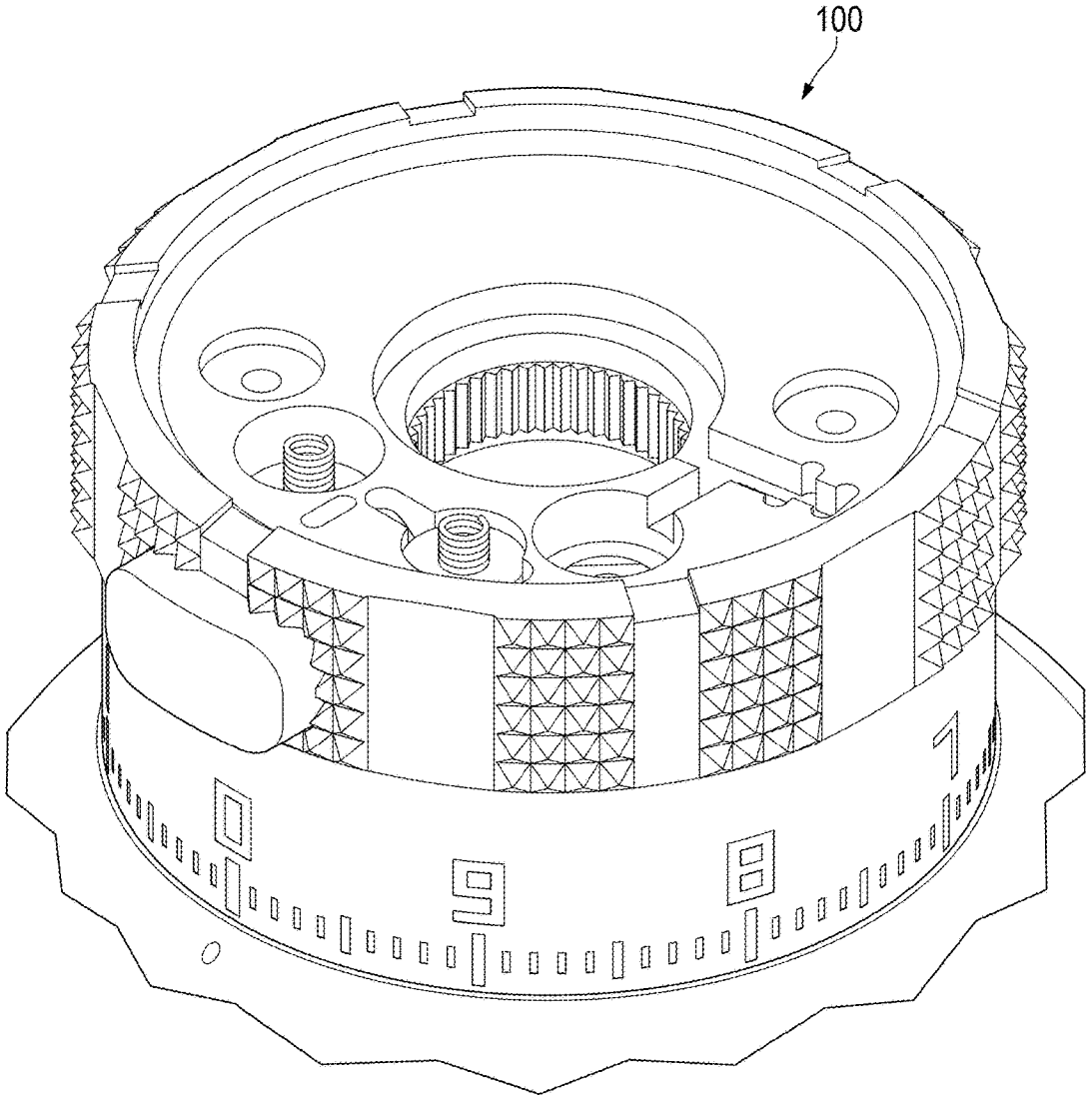
Figure 2C:
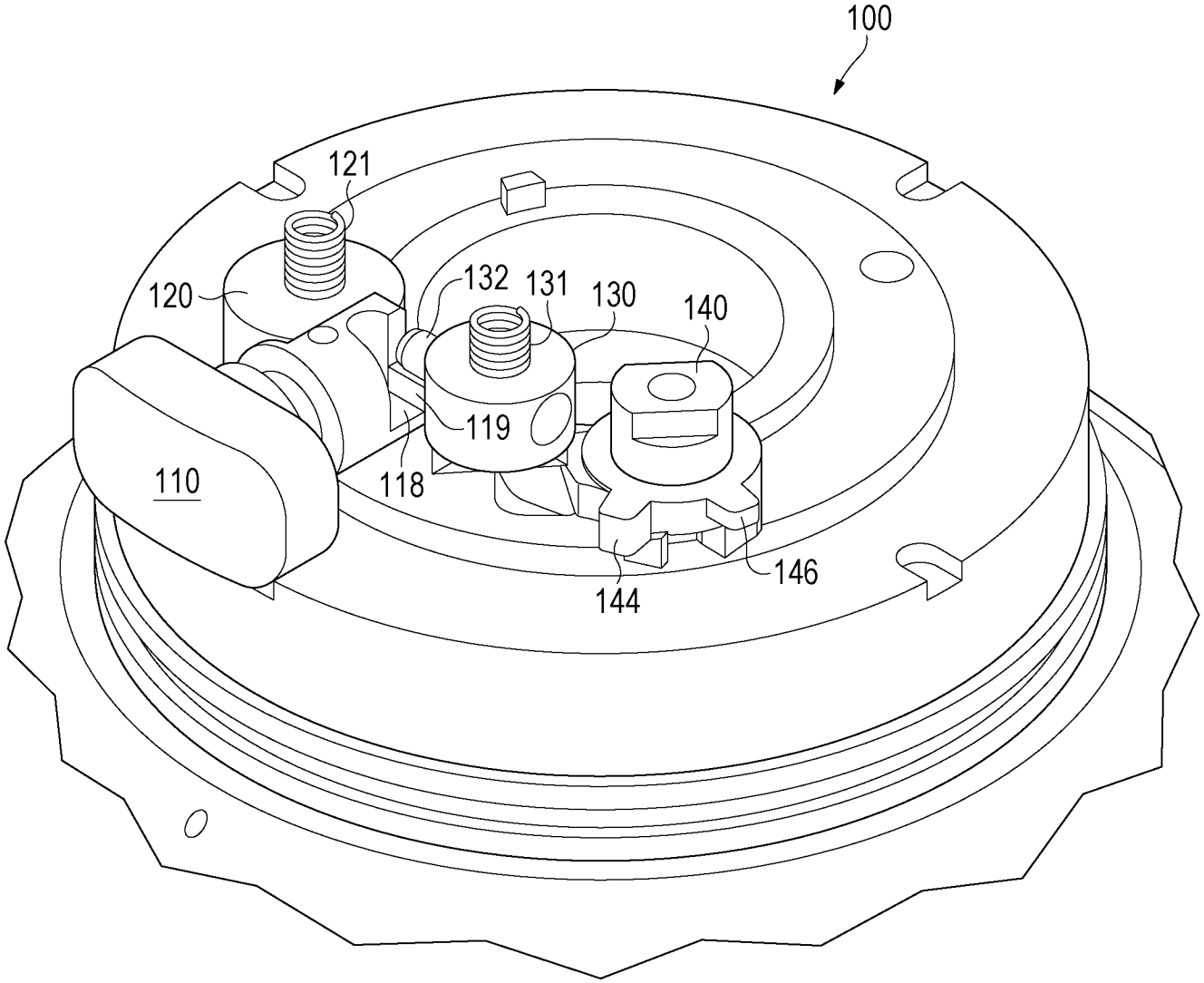
Figure 2D:
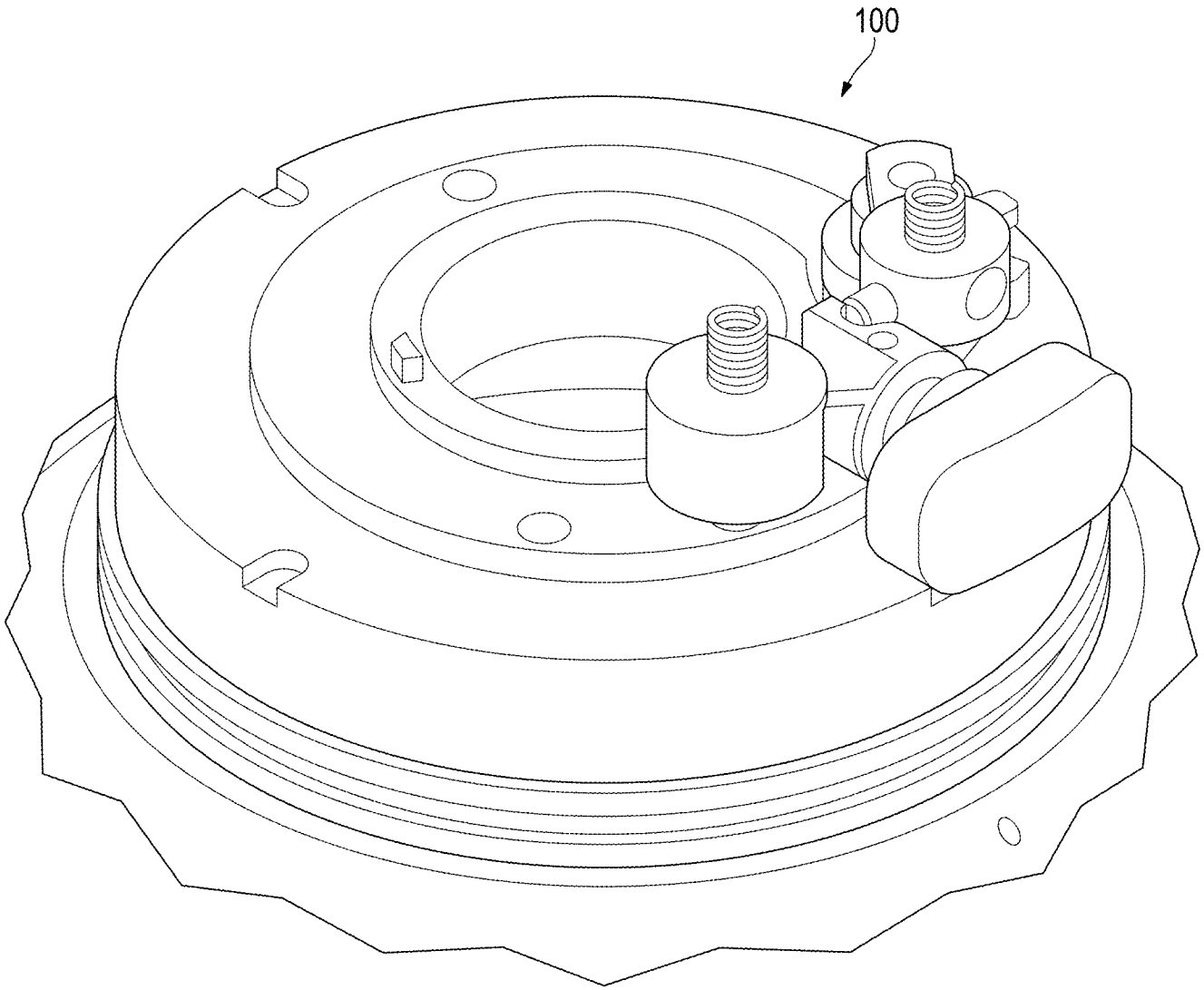
Figure 2E:
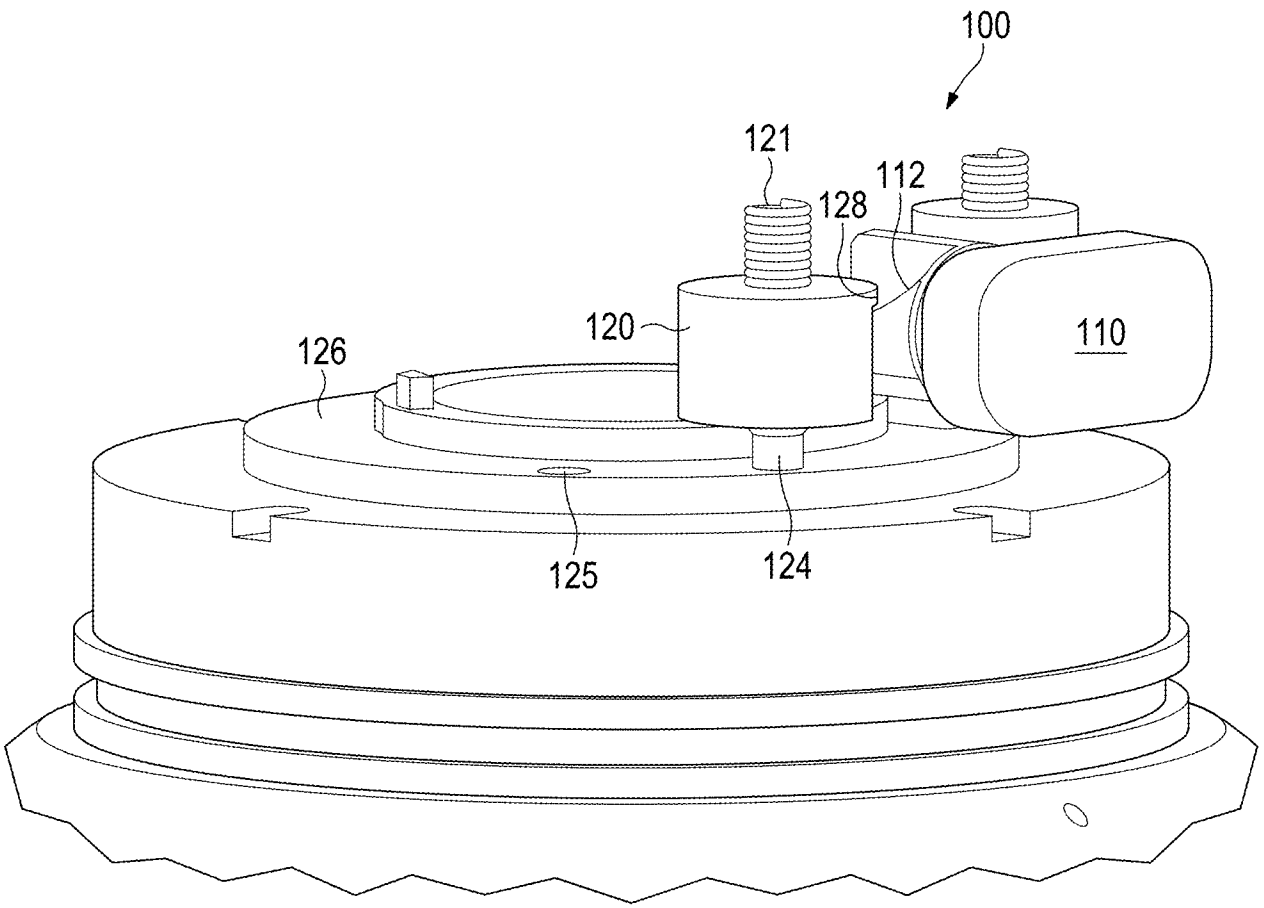
Figure 2F:
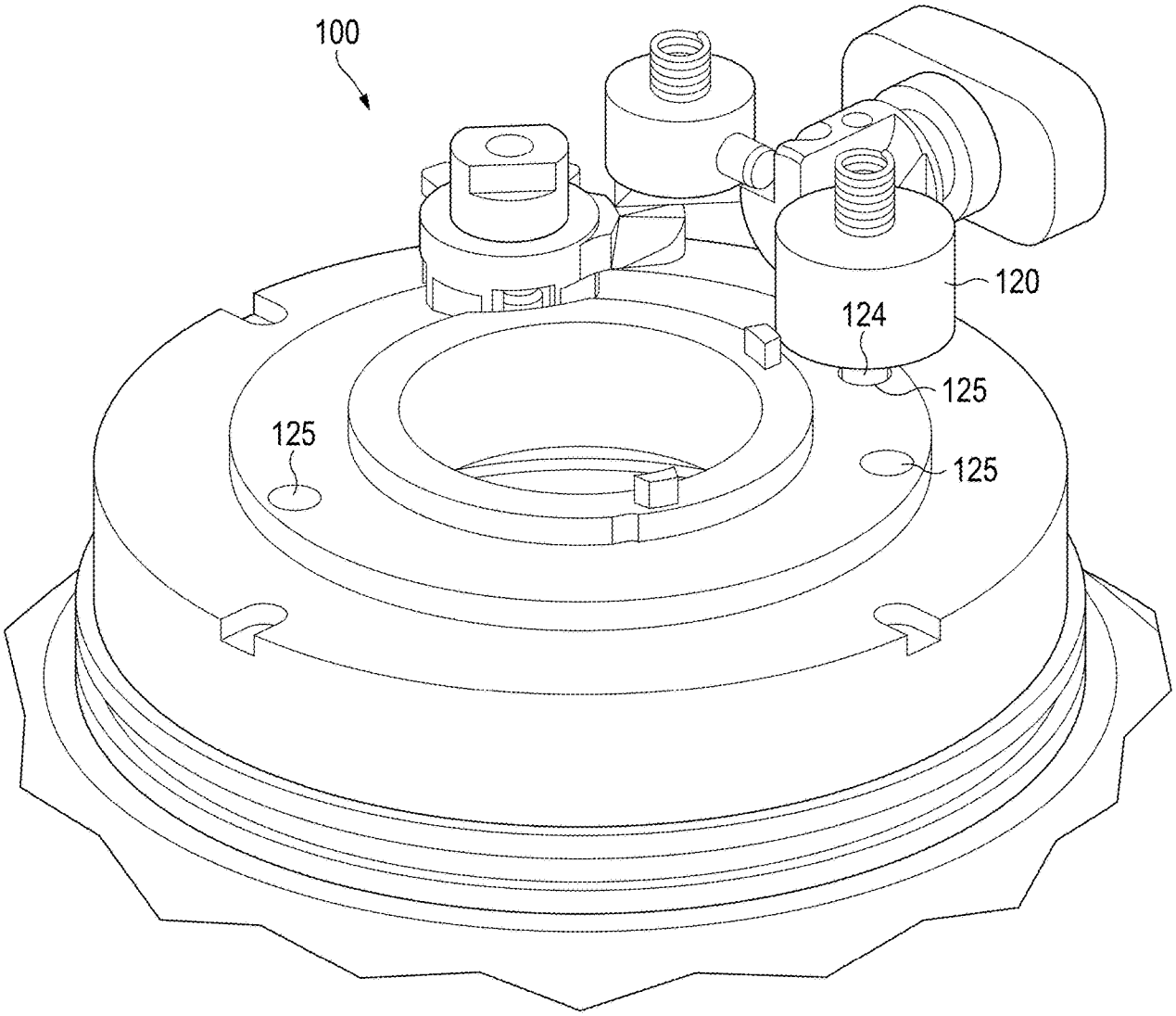
Figure 6A:
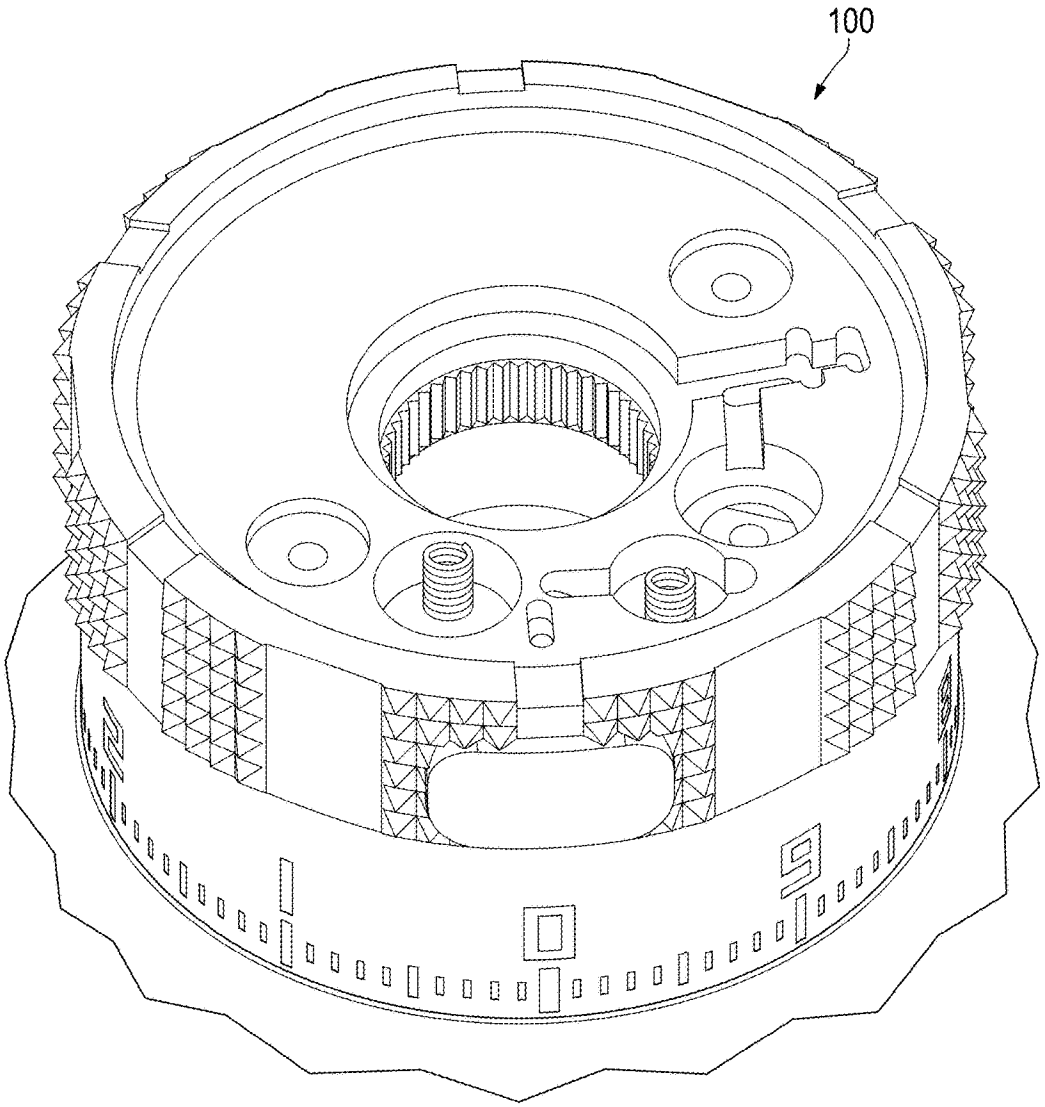
FIGS. 6A, 6B, and 6C are various perspective views illustrating components of the adjustable elevation turret of FIG. 1 in a second positively adjusted, unlocked position according to embodiments of the disclosure.
Figure 6B:
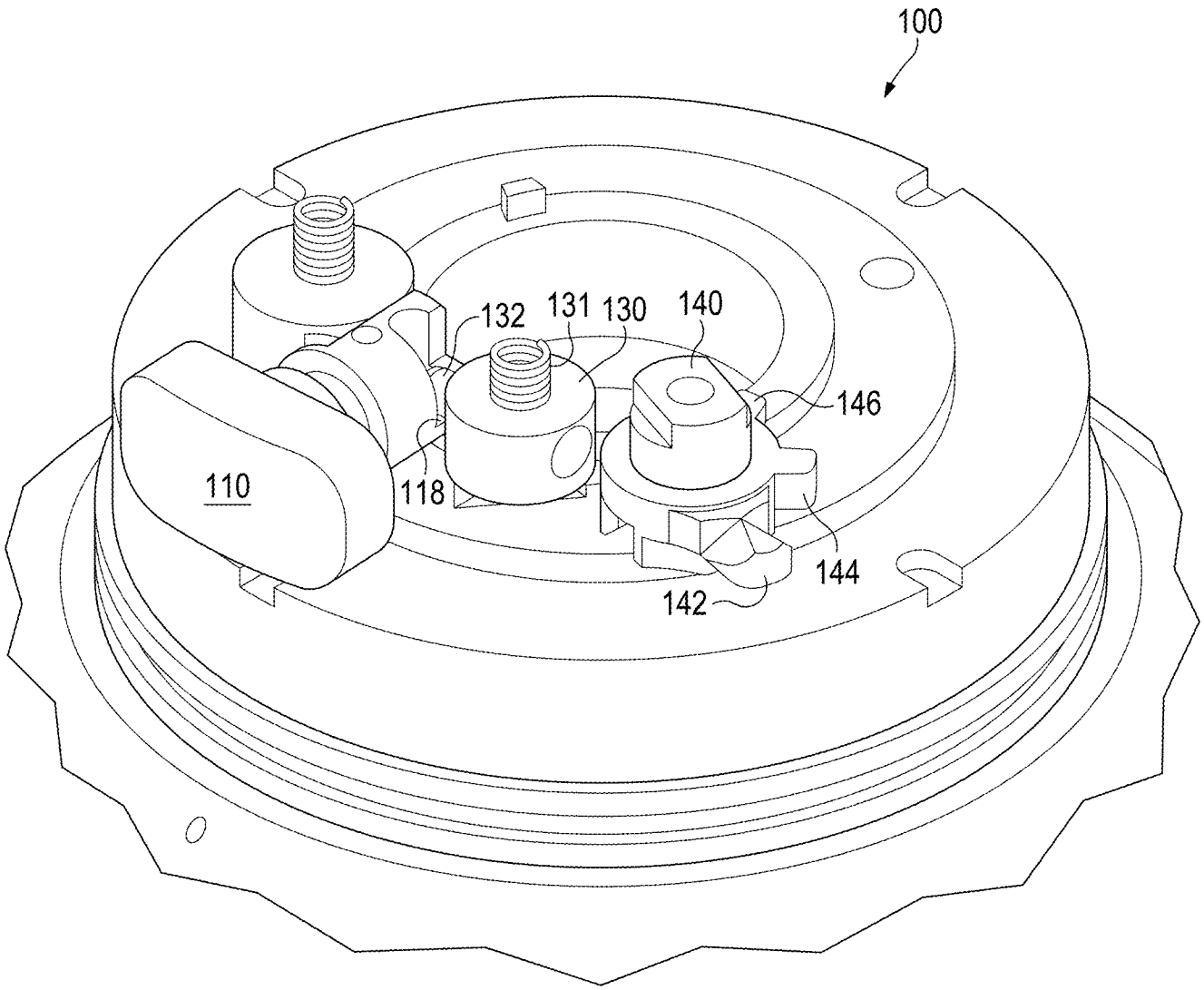
Figure 6C:
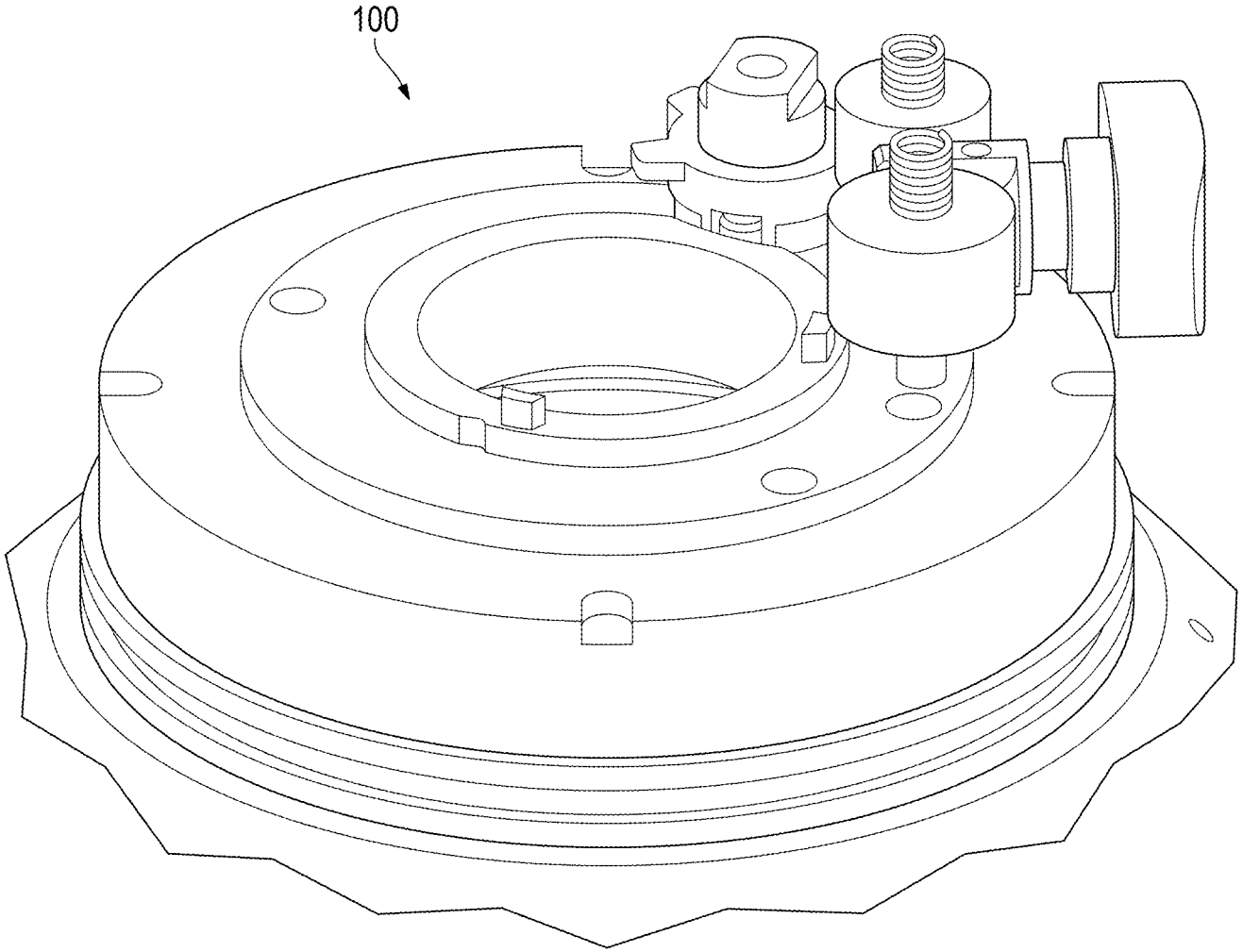

FIGS. 2C and 6B illustrate the operation of retaining or releasing the lock release 110 by operation of a retainer 130, which either maintains the elevation turret 100 in an unlocked state or allows the elevation turret to lock based on the rotational position of the elevation turret. Like the lock 120, the retainer 130 is generally cylindrically shaped and moves in a vertical direction within an aperture 139, illustrated in FIG. 2A. A retainer spring 131 normally biases the retainer 130 in a downward direction, toward the locking plate 126. A retainer pin 132 extends from the retainer 130 and raises or lowers as the retainer 130 is itself raised or lowered. As best illustrated in FIG. 6B, when the elevation turret 100 is in an unlocked position, the lock release 110 is retained in its inward position, which, as described above, causes the locking pin 124 to be raised out of its locking hole 125, and allows the user to freely rotate the elevation turret 100. When in this unlocked position, the lock release 110 is retained inward by operation of the retaining pin 132 of the retainer 130 being captured within a retaining slot 118, which is formed as part of or connected to the lock release 110. The retaining slot 118 is more clearly illustrated in FIG. 2C. Referring back to FIG. 6B, when the elevation turret 100 is in an unlocked position, the retaining pin 132 is held within the retaining slot 118 by operation of the retainer spring 131 maintaining the retaining pin 132 in the retaining slot. When in this position, the pin 132 mechanically interferes with a lip 119 of the slot 118 to prevent the lock release 110 from returning outward to its locked position. The lip 119 of the retaining slot 118 is illustrated in FIG. 2C. Conversely, and with reference to FIG. 2C, when the elevation turret 100 is in its locked position, the retainer 130 is raised upwardly by a pawl 140, the full function of which is described below, to overcome the bias of the retainer spring 131, which likewise raises the retaining pin 132 out of the retaining slot 118. Once the retaining pin 132 is free from the retaining slot 118, the bias of the lock spring 121 pushes downward on the lock 120 toward the locking plate 126. And, because the elevation turret 100 is only in a locked position when the lock pin 124 (FIG. 2E) is aligned with a locking hole 125 of the locking plate 126, the lock 120 is free to move downward within its aperture 129 (FIG. 2A) based on the bias of the lock spring 121. Further, since the ramp 112 of the lock release 110 remains in contact with the ramp 128 of the lock 120, described above, the bias of the lock spring 121 is sufficient to force the lock release 110 outward to its locked position.

So, in summary, when the lock release 110 of the elevation turret 100 is pressed inward, the ramp 112 of the lock release 110 forces the ramp 128 of the lock 120 upwards, which causes the lock pin 124 of the lock 120 to rise out of its locking hole 125 of the locking plate 126. This action frees the elevation turret 100 from its locked state and allows the user to rotate the elevation turret 110, thereby adjusting the optic within the riflescope 50. When unlocked, the lock release 110 is instead held in its inward position by action of the retainer pin 132 and the lip 119 of the retaining slot 118. Then, when the user rotates the elevation turret 100 to a pre-defined locking position, based on the position of the locking holes 125 in the lock plate 126, the locking function of the elevation turret auto-locks, where the lock pin 124 aligns with its matching locking hole 125 and is forced into the locking hole by operation of the lock spring 121. In concert, as the elevation turret 100 is being rotated to one of its locking positions, the retainer pin 132 is freed from the retaining slot 118 by action of the pawl 140, described below. When the retainer pin 132 is raised past the lip 119 of the retaining slot 118 in the lock release 110, the retainer pin no longer maintains the lock release 110 in the inward position, and instead allows the lock release 110 to move outward to the unlocked position. This outward movement of the lock release 110 is ultimately caused by the lock spring 121. Once the retainer pin 132 is free from the retaining slot 118, the lock spring 121 pushes the lock 120 in a downward direction, where the downward force on the ramp 128 is applied as a sliding force along the ramp 112, which causes the lock release 110 move outward to its fully locked position.

As described above, much of the function of the locking and unlocking of the elevation turret 100 is performed with operation of the lock release 110. Pushing the lock release 110 inward forces the lock 120 from its locking position and unlocks the elevation turret 110, allowing the elevation turret to be rotated by the user. Also, when unlocked, the retainer 130 maintains the lock release 110 in its inward position, which, in turn, keeps the elevation turret 100 in the unlocked position as the user rotates the elevation turret to adjust the riflescope 50. In the illustrated embodiment, the retainer 130 maintains the lock release 110 in its inner, retained, position in all except three positions of rotation of the elevation turret 100. In the illustrated embodiment, these three positions are the negative end of travel, a zero position, and the positive end of travel. The negative end of travel occurs when the elevation turret 100 has been rotated as far as mechanically possible in the negative direction, which in the illustrated embodiment is the counterclockwise direction. This mechanical limit is determined by the negative adjustment limit of the optic to which the elevation turret 100 is coupled. Conversely, the positive end of travel occurs when the elevation turret 100 has been rotated as far as mechanically possible in the positive direction, which in this case is the clockwise direction. This mechanical limit is also determined by the adjustment limit of the optic. The zero position is a rotational position that falls between the minimum and maximum travel positions. Typically, the zero position is set to be much closer to the negative end of travel than the positive end. In one embodiment, the negative end of travel of the elevation turret occurs at −2.5 milliradians (mrads), the positive end of travel occurs at 25 mrads, and the zero position is set at 0 mrads. As with most aiming devices, the relative position of 0 mrads may be changed relative to the actual optics of the riflescope 50 by removing the dial 104 from the riflescope 50 (FIG. 1) and placing it back on the riflescope at a pre-set position. For example, a user may sight a riflescope 50 to a target distance at 200 meters, remove the dial 104, then place the dial back so that its zero markings are now set at 200 meters. Then, any adjustments made by rotating the elevation turret 100 are made relative to the new zero position of 200 meters. Although this description and the drawings illustrate an embodiment having three lock positions, at the extremes of travel plus a zero position, not all embodiments according to this disclosure need to have exactly these positions, and the number and location of the lock positions may be chosen by the designer based on implementation decisions and details.

As described above, a pawl 140, best seen in FIG. 6B, controls the operation of the retainer 130, either raising it in its aperture 139 against the bias of the retainer spring 131 so that the retaining pin 132 no longer retains the lock release 110 in its inward position (unlocked position), or by not lifting the retainer 130 within its aperture and therefore allowing the retainer spring 131 to seat the retaining pin 132 into its mating receiver slot 118, which functions to retain the lock release 110 in its inward, unlocked position. The pawl 140 controls the vertical position of the retainer 130 by the operation of tabs 142, 144, 146. As the pawl 140 rotates into a position that corresponds to a locked position of the elevation turret 100, one of the tabs 142, 144, or 146 contacts an underside of the retainer 130 and forces or maintains it in its upward position, overcoming the bias of the retainer spring 131. In some embodiments the shape of the underside of the retainer 130 and the shape of the tabs 142, 144, 146 are cooperative to allow the retainer 130 to precisely raise or lower within. 1 mrad. For example, the position −0.1 mrad is an unlocked position, while 0 mrad is a locked position. Various shapes of the tabs 142, 144, 146 are illustrated in FIG. 6B. In particular, the beveled edges of the tabs 142, 144, 146 cooperate with a beveled undersurface of the retainer 130 (undersurface not illustrated) to provide significant vertical movement of the retainer 130 with a minimum of rotational movement of the pawl 140.

An underside of the pawl 140 includes a mechanism to cause rotational movement of the pawl 140 as the elevation turret 100 is rotated. In one embodiment the mechanism is a Geneva Mechanism including a series of slots that receive a pin that remains stationary as the elevation turret 100 is rotated. In this case, the user rotating the elevation turret 100 causes one of the slots of the Geneva Mechanism to align with the stationary pin, which enters the slot due to the rotation of the turret. Then, with continued rotation, the Geneva Mechanism on the underside of the pawl 140 causes the pin to contact one of the edges of the slot, which, in turn, causes the pawl to rotate by an amount that is exactly related to the amount of rotation of the elevation turret 100. The Geneva Mechanism causes the pawl 140 to rotate a specific amount based on the rotation of the elevation turret 100. When one of the tabs 142, 144, 146 on the top side of the pawl 140 is rotated to a position where it contacts the retainer 130, continued rotation of the elevation turret 100 causes the retainer 130 to rise, as described above. When the retainer 130 raises, the retaining pin 132 escapes the lip 119 of the retaining slot 118, which frees the lock release 110 to return to its locked position. At most of the possible rotational positions of the elevation turret 100, none of the tabs 142, 144, 146 of the pawl 140 actually contacts the retainer 130, which means that, for most of the rotational positions, the retainer tab 132 of the retainer keeps the lock release 110 in its inward, unlocked position, and the elevation turret is unlocked.

The operation of the locking elevation turret 100 and its components is now described with reference to Table 1 and the Figures. Table 1 describes the relationship and operation of major components of the elevation turret 100 when the elevation turret is in various rotational positions. Table 1 describes the position and/or orientation of major components of the elevation turret 100 at its three locking positions, as well as all other positions.

TABLE 1

| | Lock position 1 | Lock position 2 | Lock position 3 | Unlocked positions |
|---|---|---|---|---|
| Dial 104 rotational position | −10 clicks (−1 mrad) | Zero | +250 clicks (+25 mrad) | All others |
| Lock Release 110 Position | Out | Out | Out | In |

TABLE 1-continued

| | Lock position 1 | Lock position 2 | Lock position 3 | Unlocked positions |
|---|---|---|---|---|
| Pawl 140 orientation | Contacting and lifting retainer 130 with tab 142 | Contacting and lifting retainer 130 with tab 144 | Contacting and lifting retainer 130 with tab 146 | Not contacting nor lifting retainer 130 |
| Retainer pin 132 position | Disengaged from retaining slot 118, allowing lock release 110 to return to its outward position | Disengaged from retaining slot 118, allowing lock release 110 to return to its outward position | Disengaged from retaining slot 118, allowing lock release 110 to return to its outward position | Retained in retaining slot 118, keeping lock release 110 in inward position |
| Locking pin 124/ locking hole 125 | Locking pin 124 inserted into locking hole 125 | Locking pin 124 inserted into locking hole 125 | Locking pin 124 inserted into locking hole 125 | Locking pin 124 not inserted into locking hole 125 |

Figure 2G:
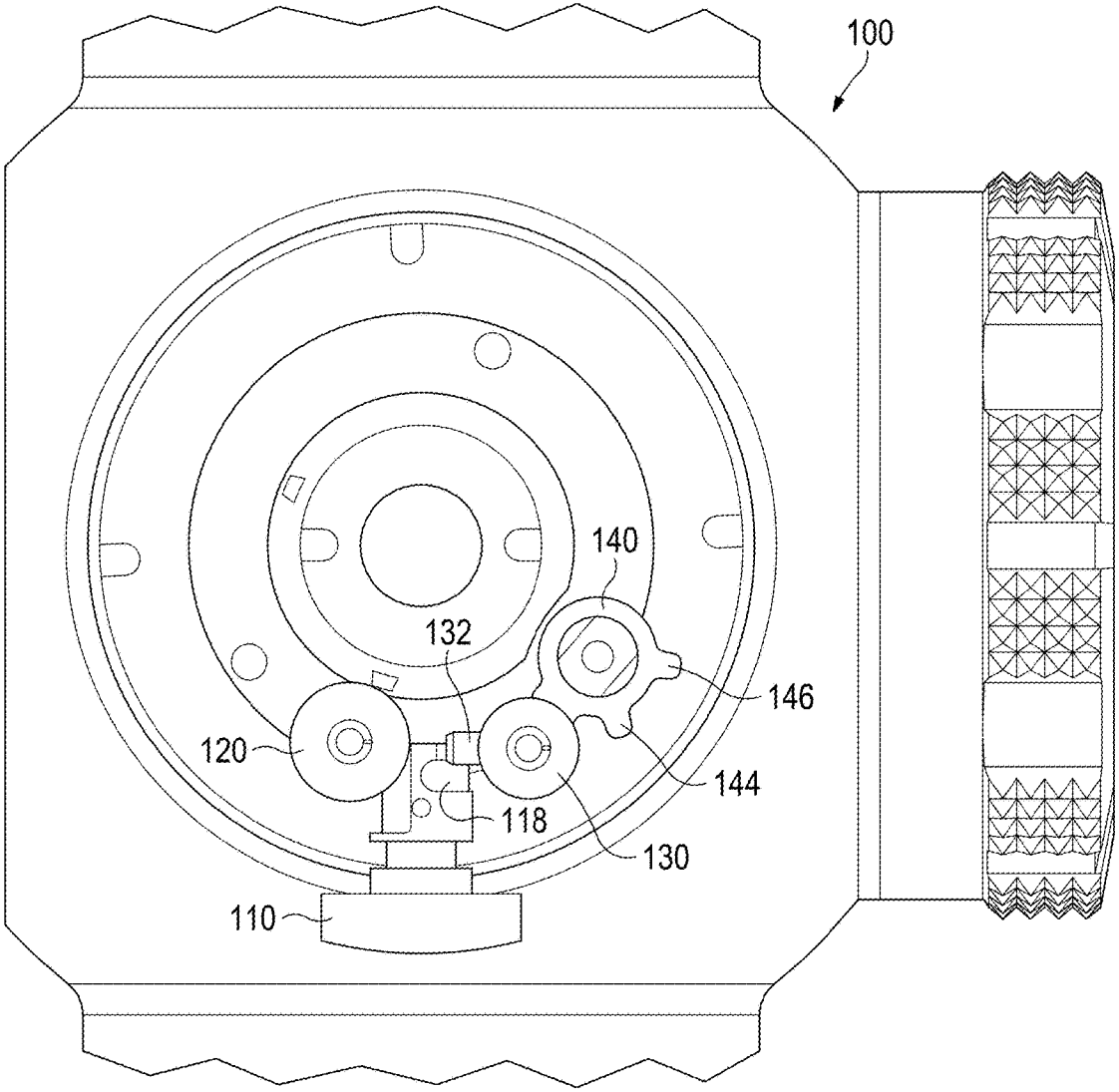

FIGS. 2A, 2B, 2C, 2D, 2E, and 2F are various perspective views illustrating components of the adjustable elevation turret 100 in the zero, locked position according to embodiments of the disclosure, and FIG. 2G is a top plan view in the same position. With reference to Table 1, FIGS. 2A-2G illustrate the rotational position of the elevation turret described in the column labeled Lock position 2. In this position, the rotational position of the elevation turret 100 is locked. As such, the lock release 110 is in its "out" position, which is clearly shown in FIGS. 2A and 2B. It should be mentioned that all of the components illustrated in the set of FIGS. 2A-2G are in the same position, with various other components of the elevation turret 100 included in the views, or not, for clarity, and different angles of perspective are illustrated. Perhaps best seen in FIGS. 2C and 2G, in this zero-lock orientation, the pawl 140 has been rotated such that the tab 142 is contacting the retainer 130 and raising the retainer upwards. Table 1 describes the retainer pin 132 as being disengaged from the retaining slot 118, which can be viewed in FIG. 2G. This disengagement of the retainer pin 132 from its retaining slot 118 allows the button 110 to return to its outward, locked, position. Table 1 also describes that the locking pin 124 and one of the locking holes 125 are engaged in their locking position, with the locking pin fully inserted into the locking hole, which may be best viewed in FIGS. 2D and 2E. When the locking pin 124 is inserted into any of the locking holes 125, the elevation turret 100 is in its locked position, and the dial 104 will not rotate without being damaged. And, because the dial 104 is coupled to the optic adjustment in the riflescope 50, the optic maintains its position when the elevation turret 100 is in its locked position.

Figure 3A:
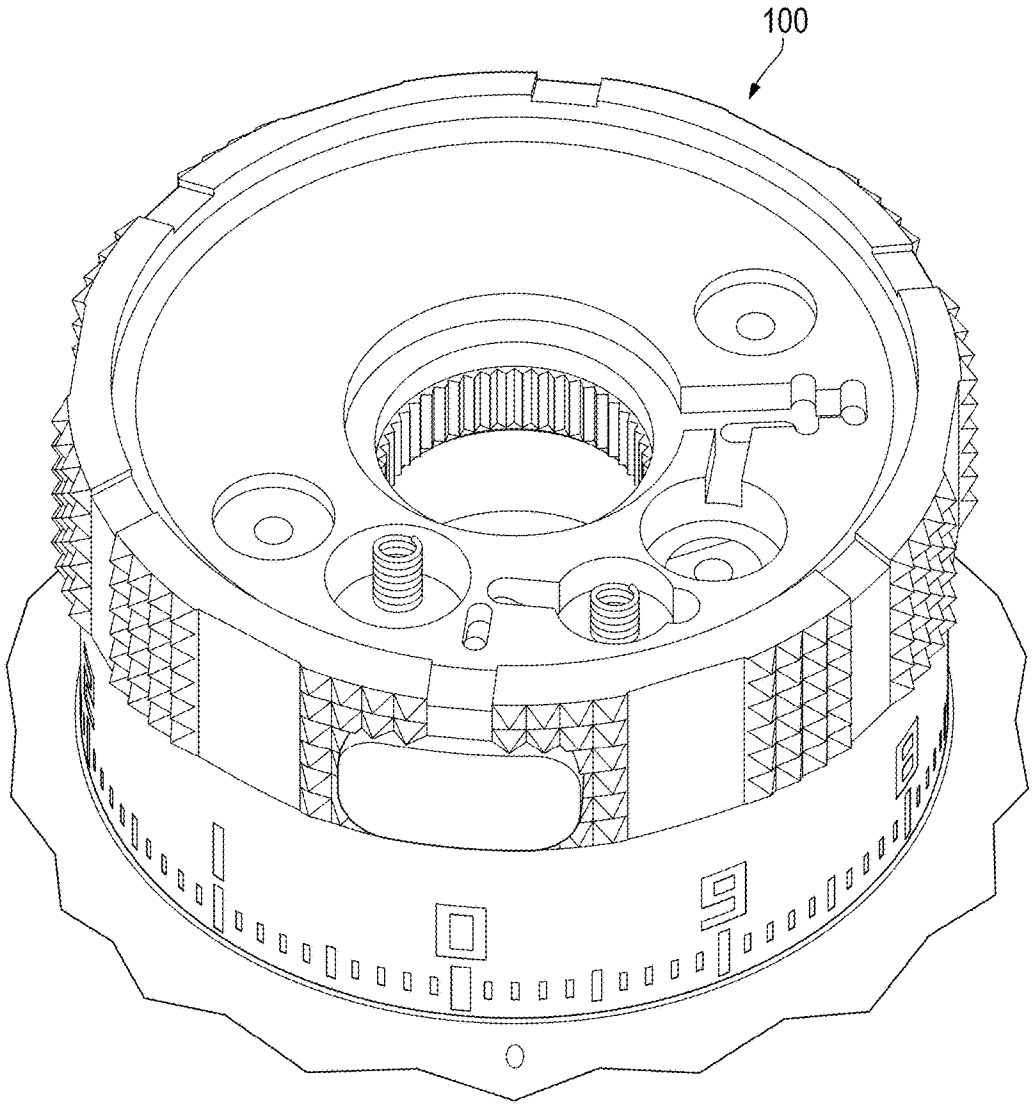
FIGS. 3A, 3B, 3C, and 3D are various perspective views illustrating components of the adjustable elevation turret of FIG. 1 in a negatively adjusted, unlocked position according to embodiments of the disclosure.
Figure 3B:
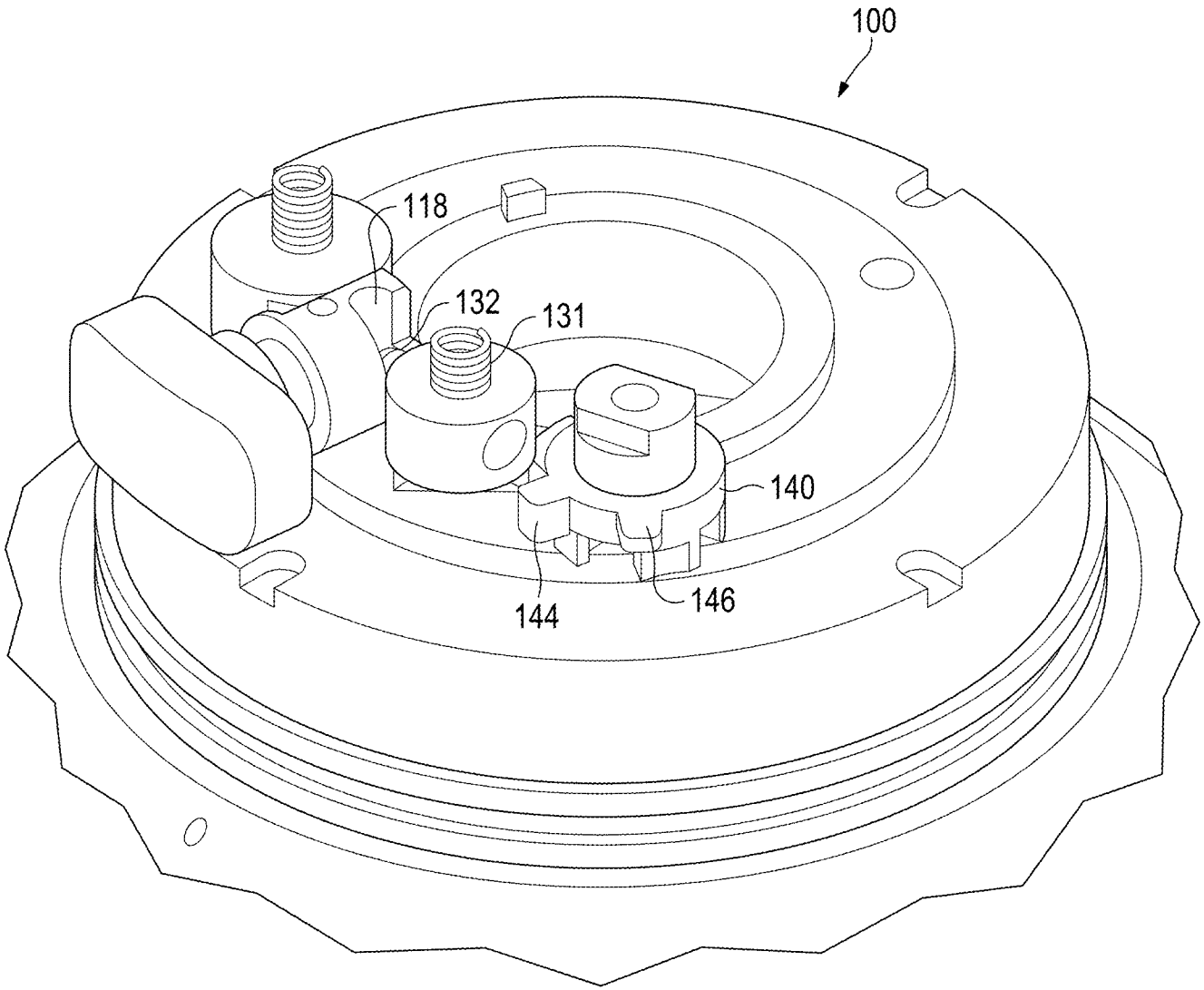
Figure 3C:
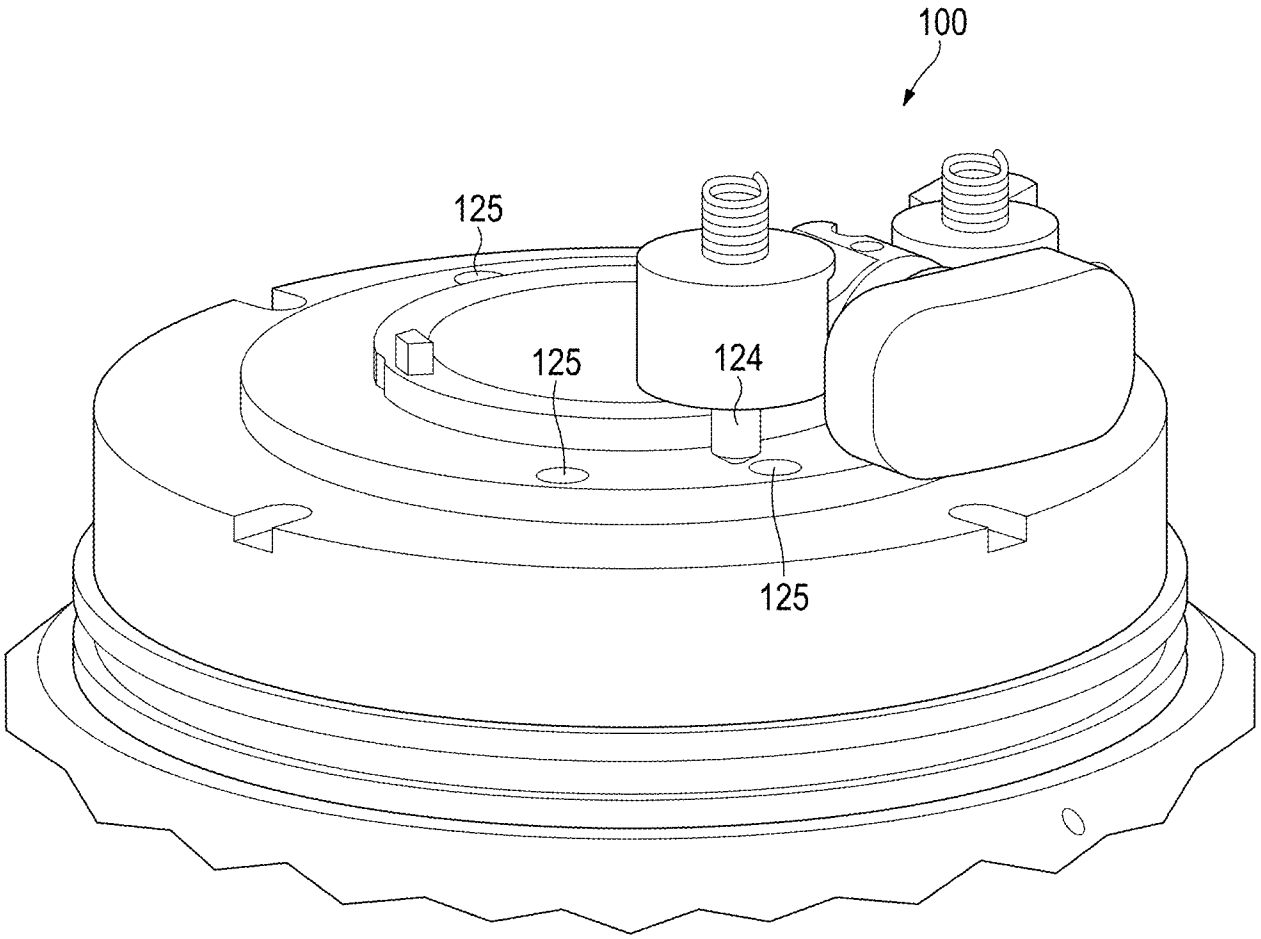
Figure 3D:
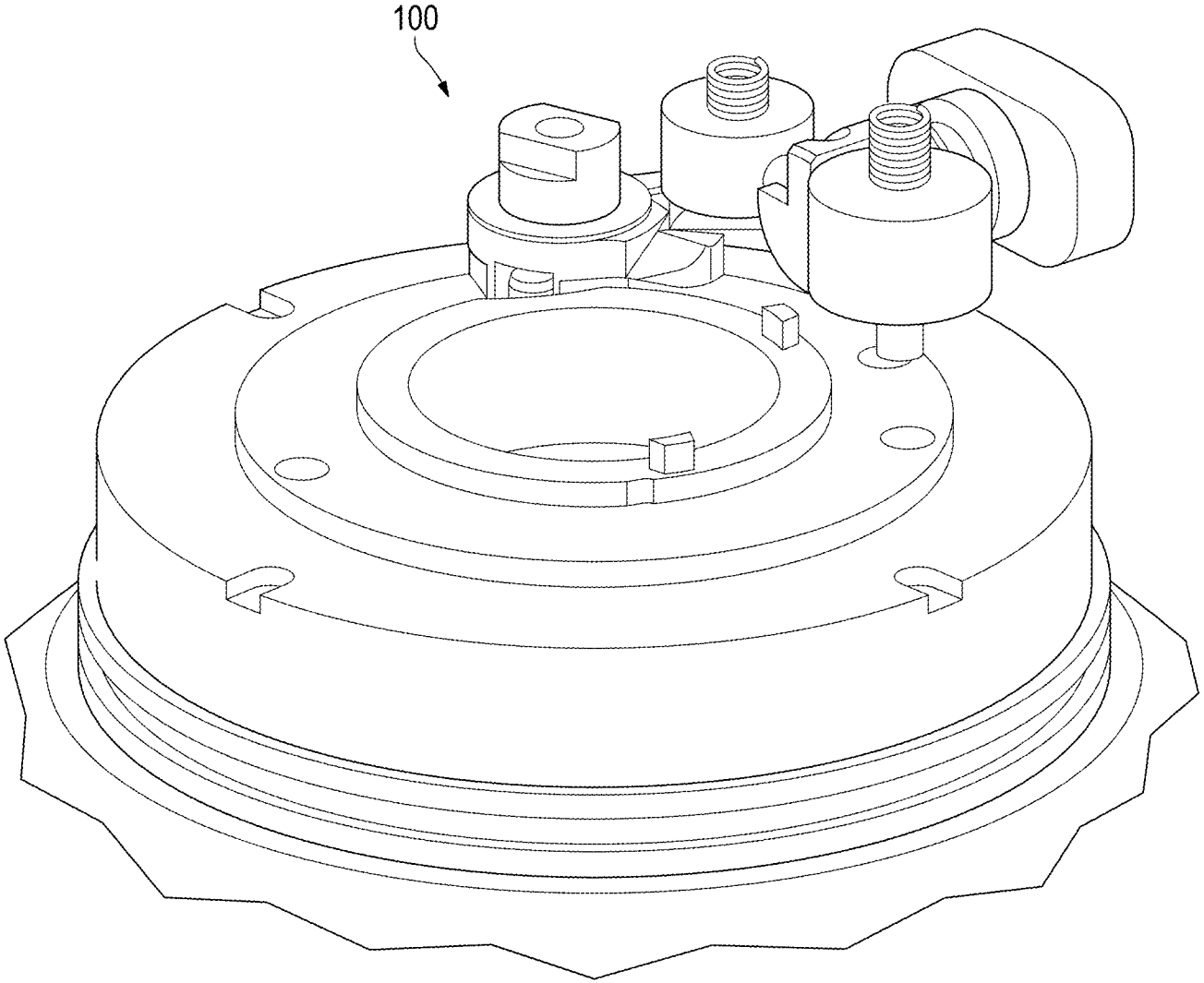

FIGS. 3A, 3B, 3C, and 3D illustrate the components of the adjustable elevation turret 100 after the turret has been rotated counterclockwise from its zero position, but not rotated so far to be in the −1 mrad, locked position, according to embodiments of the disclosure. This rotational position of the elevation turret 100 illustrated in FIGS. 3A-3D corresponds in Table 1 to the "Unlocked positions" column, where the turret 100 is in an unlocked position. As illustrated in FIG. 3C, note that the lock pin 124 is not inserted into any of the locking holes 125, which means that the elevation turret 100 is free to be rotated. Table 1 indicates that, in this unlocked position, the lock release 110 is in the "in" position, which is illustrated in FIG. 3A. Furthermore, FIG. 3B shows that the locking pin 132 is firmly seated in the retaining slot 118 by bias from the retainer spring 131. This configuration maintains the lock release 110 in this "in and locked" position. Also visible in FIG. 3B, none of the tabs 142, 144, 146 are contacting the retainer 130. Table 1 describes this position as the pawl 140 not contacting nor lifting the retainer 130.

Figure 4A:
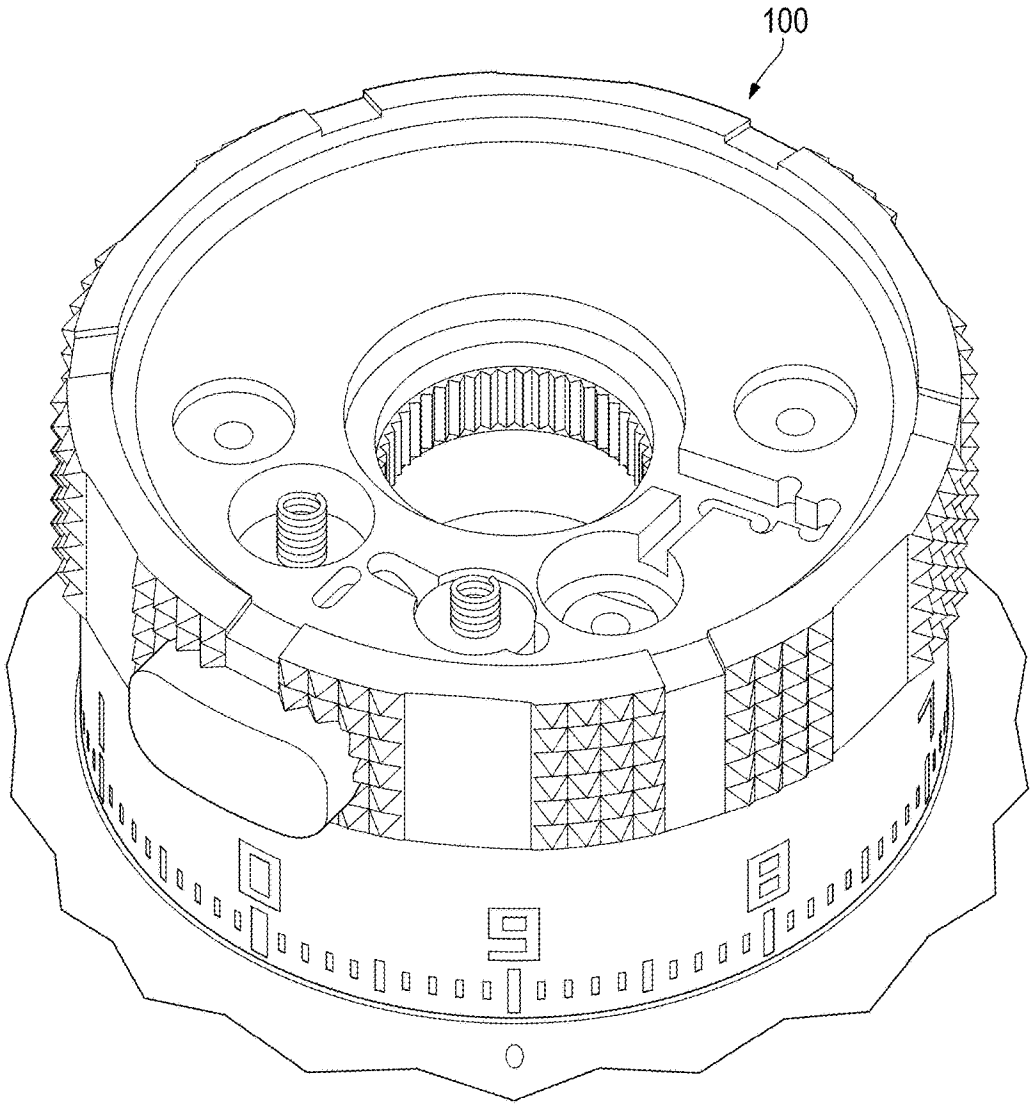
FIGS. 4A, 4B, 4C, 4D, and 4E are various perspective views illustrating components of the adjustable elevation turret of FIG. 1 in a negatively adjusted, locked position at the negative end of travel of the adjustable elevation turret according to embodiments of the disclosure.
Figure 4B:
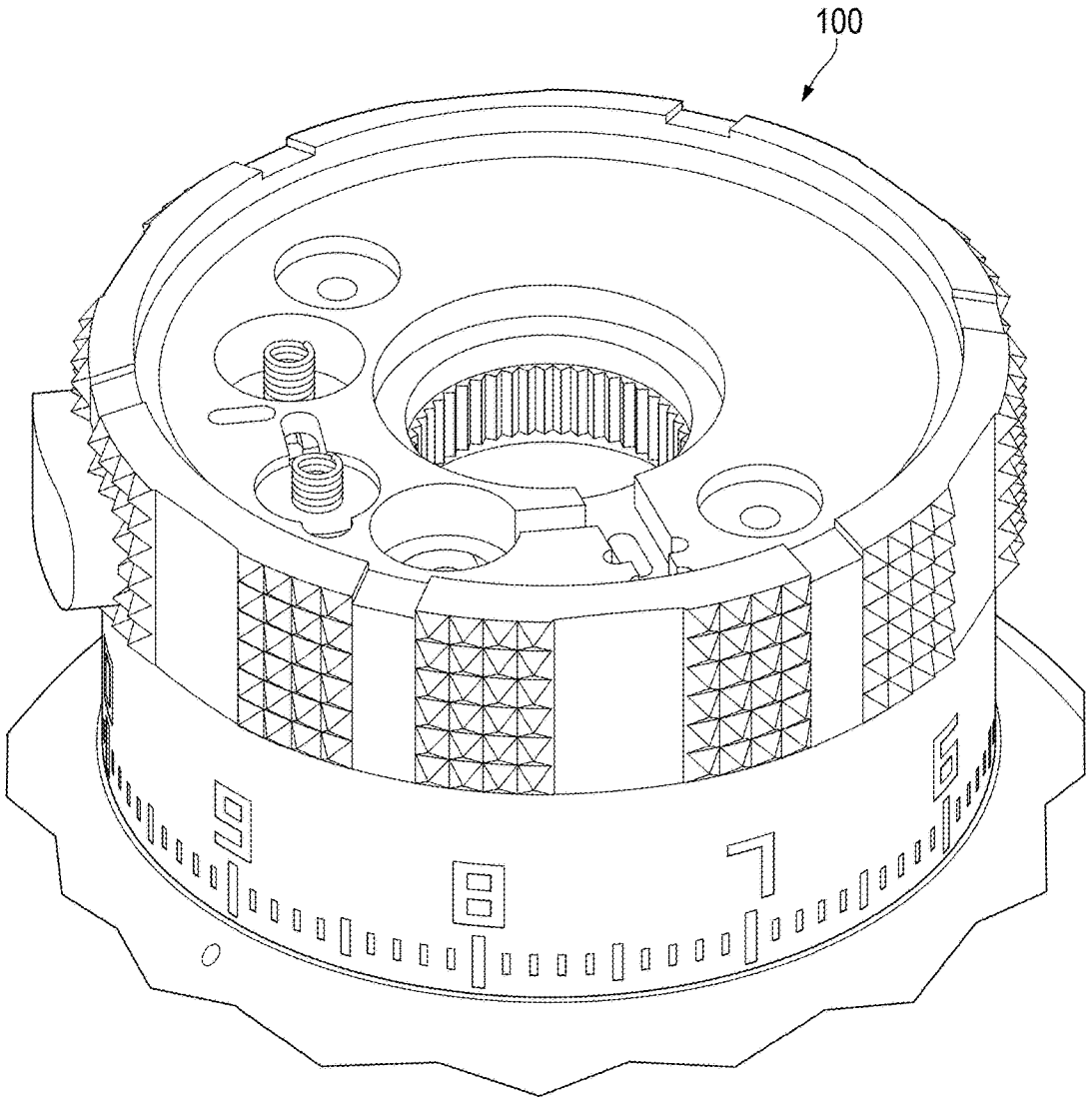
Figure 4C:
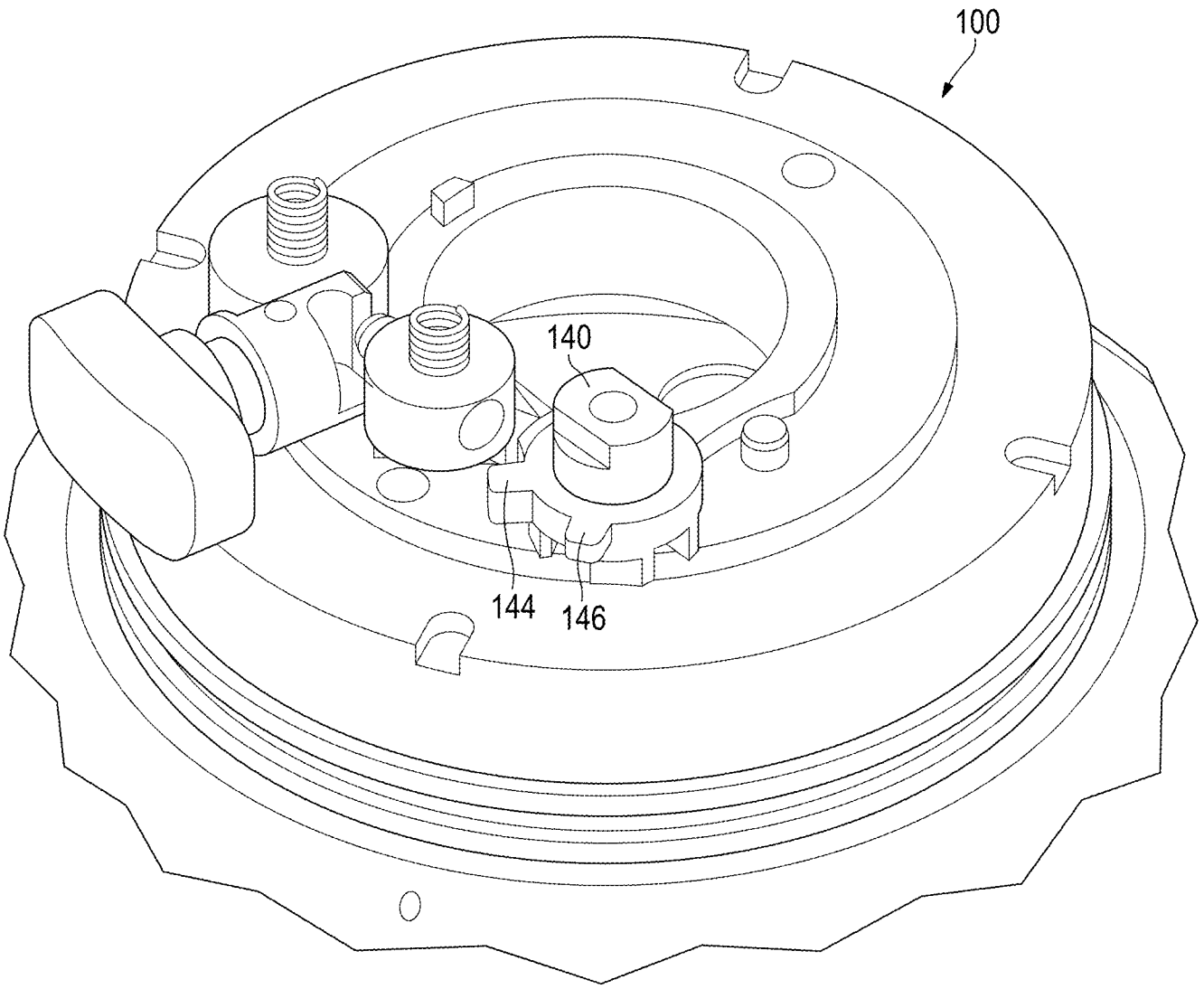
Figure 4D:
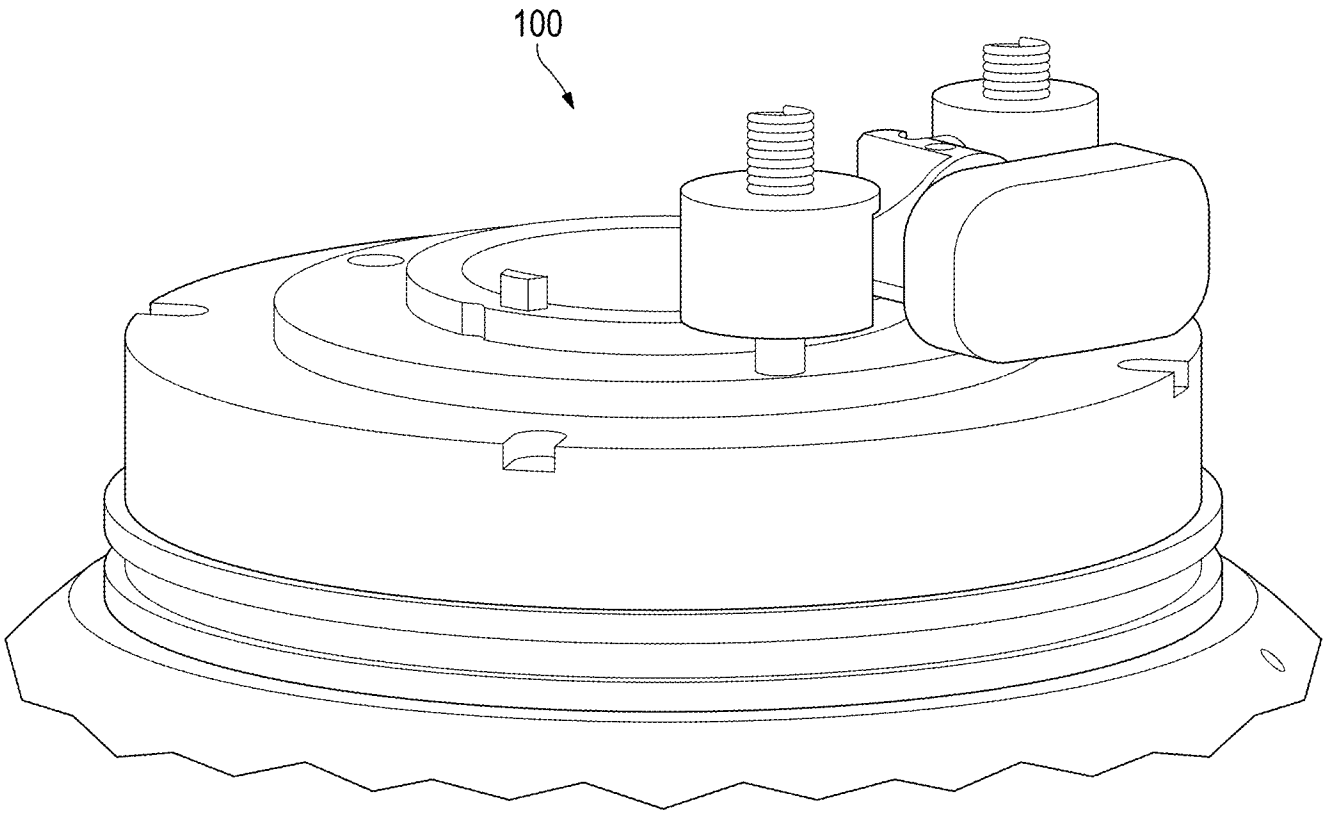
Figure 4E:
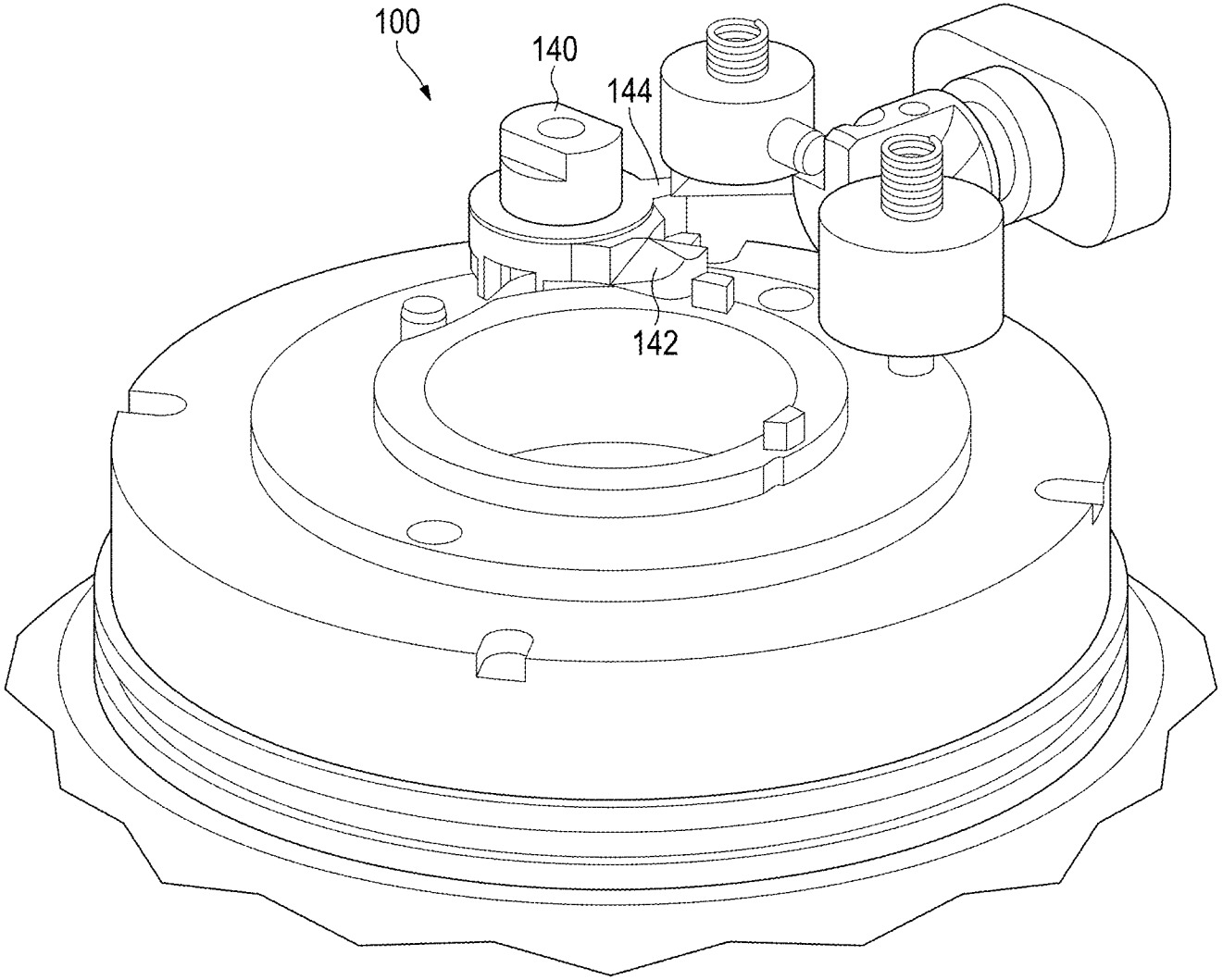

FIGS. 4A, 4B, 4C, 4D, and 4E are various perspective views illustrating components of the adjustable elevation turret 100 in a negatively adjusted, locked position at the negative end of travel according to embodiments of the disclosure. This position is described in the first column of Table 1, labeled "Lock position 1", where the elevation turret 100 is rotated −1 mrad from its zero position. This −1 mrad position is one of the locked positions of the elevation turret 100. Therefore, as illustrated in FIGS. 4A and 4B, the lock release 110 is in its outward, locked position. The retainer pin 132 is disengaged from the retaining slot 118, as illustrated in FIG. 4C, and FIG. 4E shows that the pin 124 of the lock 120 is inserted into one of the locking holes 125. The only difference between the relative positions of the elements making up the elevation turret 100 between the zero, locked position illustrated in FIGS. 2A-2G, and the −1 mrad locked position illustrated in FIGS. 4A-4E is the amount of rotation of the pawl 140. Comparing the position of the pawl 140 in FIG. 4C to the position of the pawl 140 in FIG. 2C shows that the pawl 140 has rotated slightly. In FIG. 2C, the tab "142" of the pawl 140 is under the retainer 130, causing it to rise, while in FIG. 4E, it is the tab "144" of the pawl that is under the retainer 130.

Figure 5A:
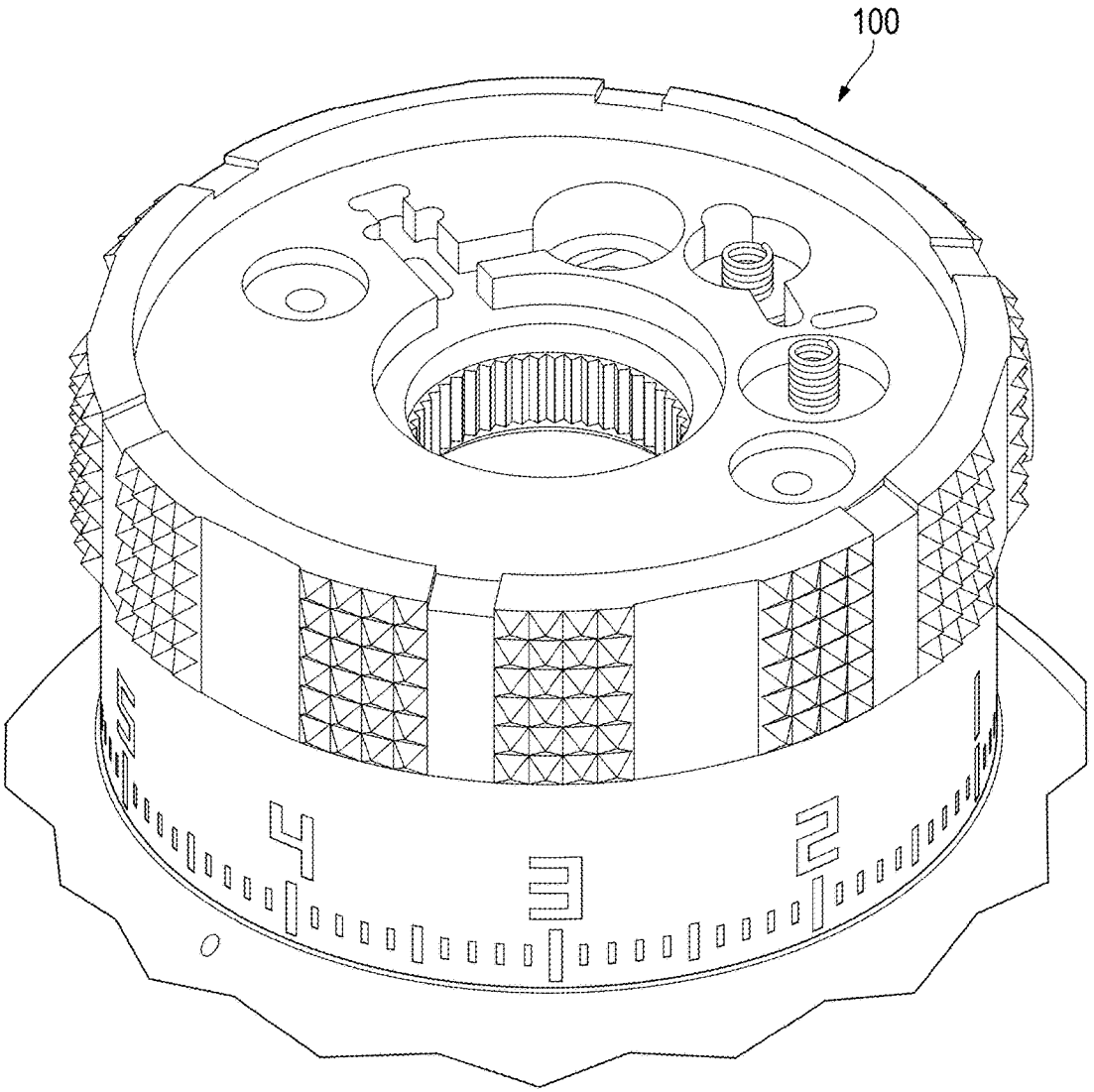
FIGS. 5A, 5B, 5C, and 5D are various perspective views illustrating components of the adjustable elevation turret of FIG. 1 in a first positively adjusted, unlocked position according to embodiments of the disclosure.
Figure 5B:
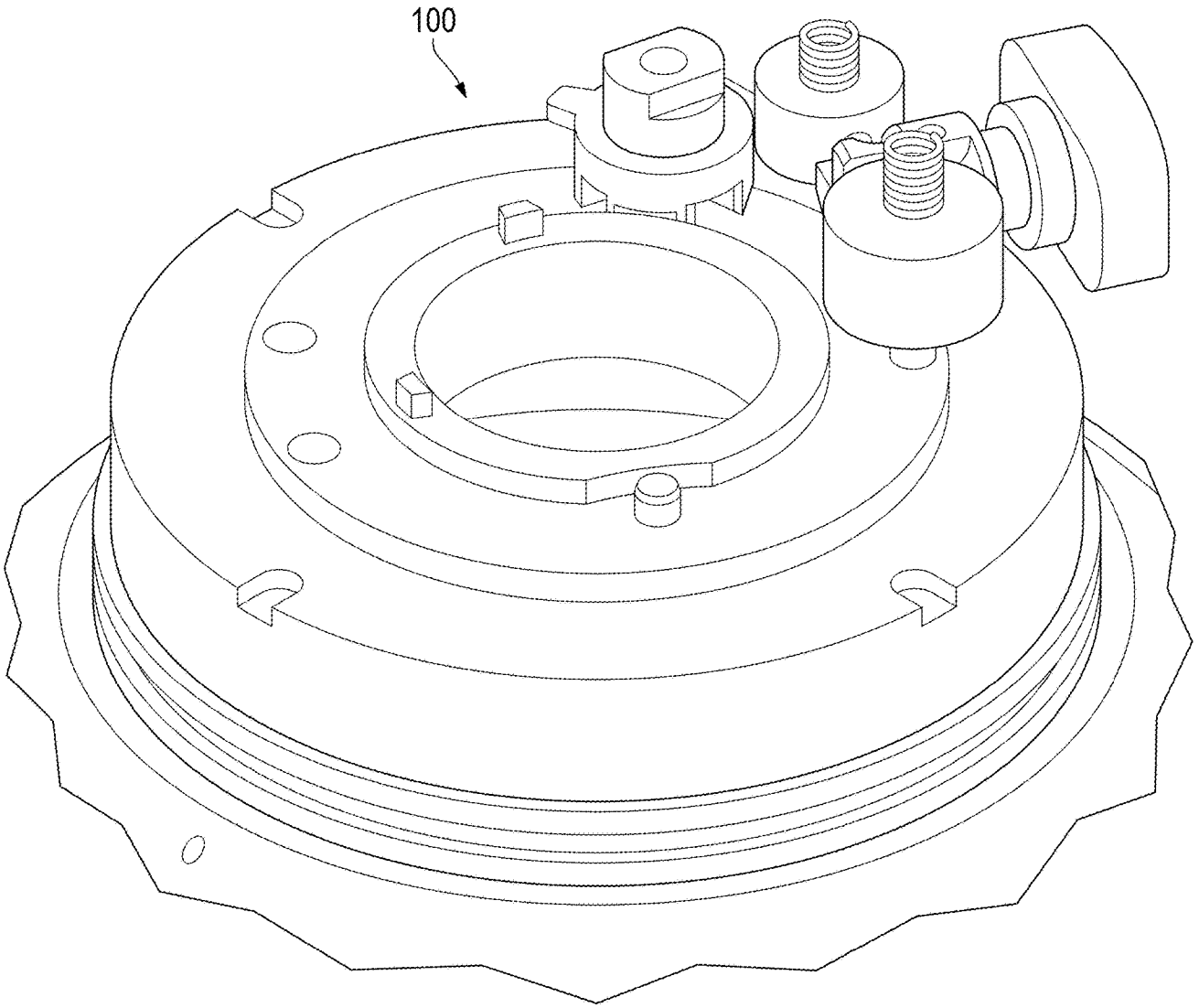
Figure 5C:
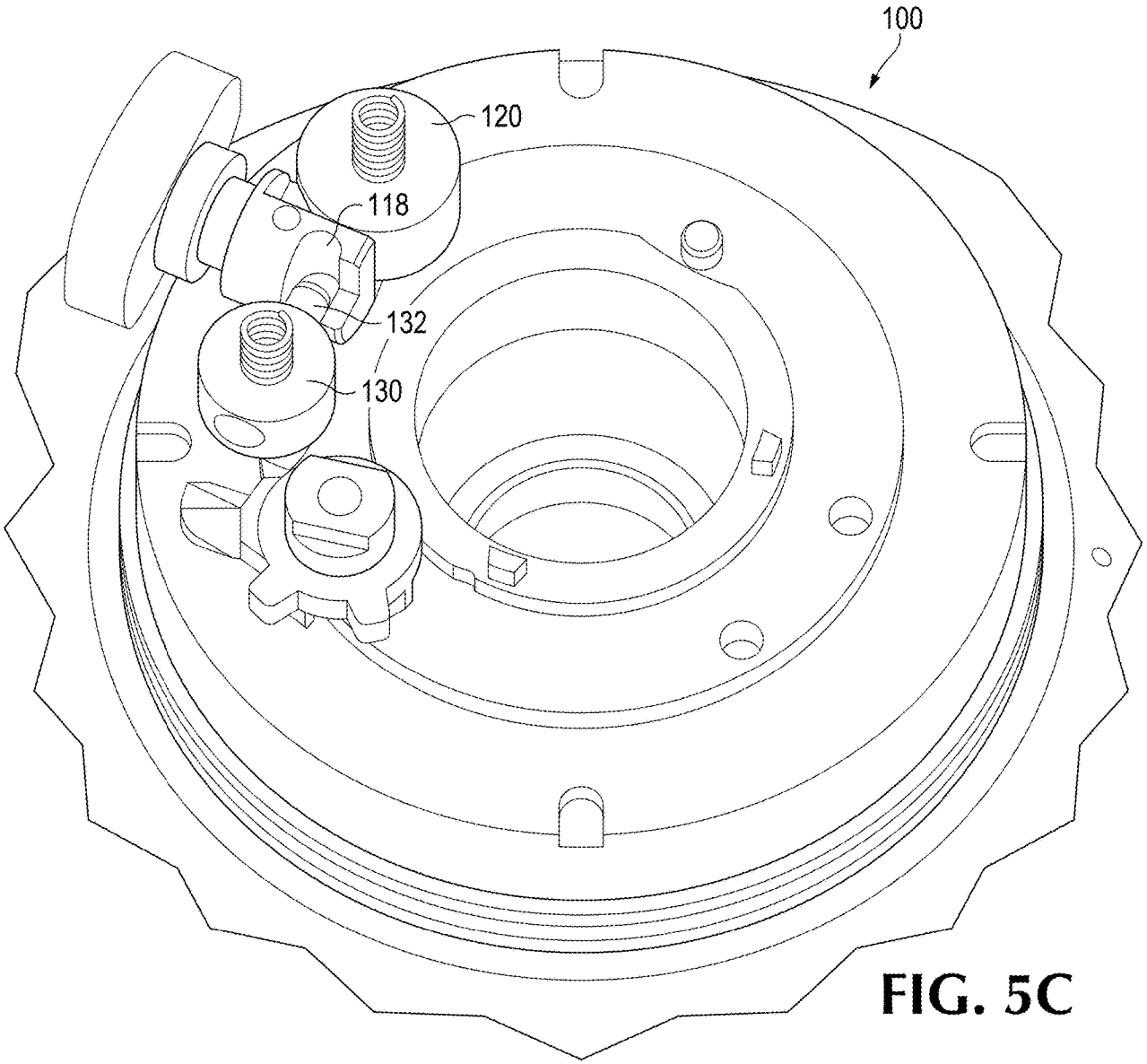
Figure 5D:
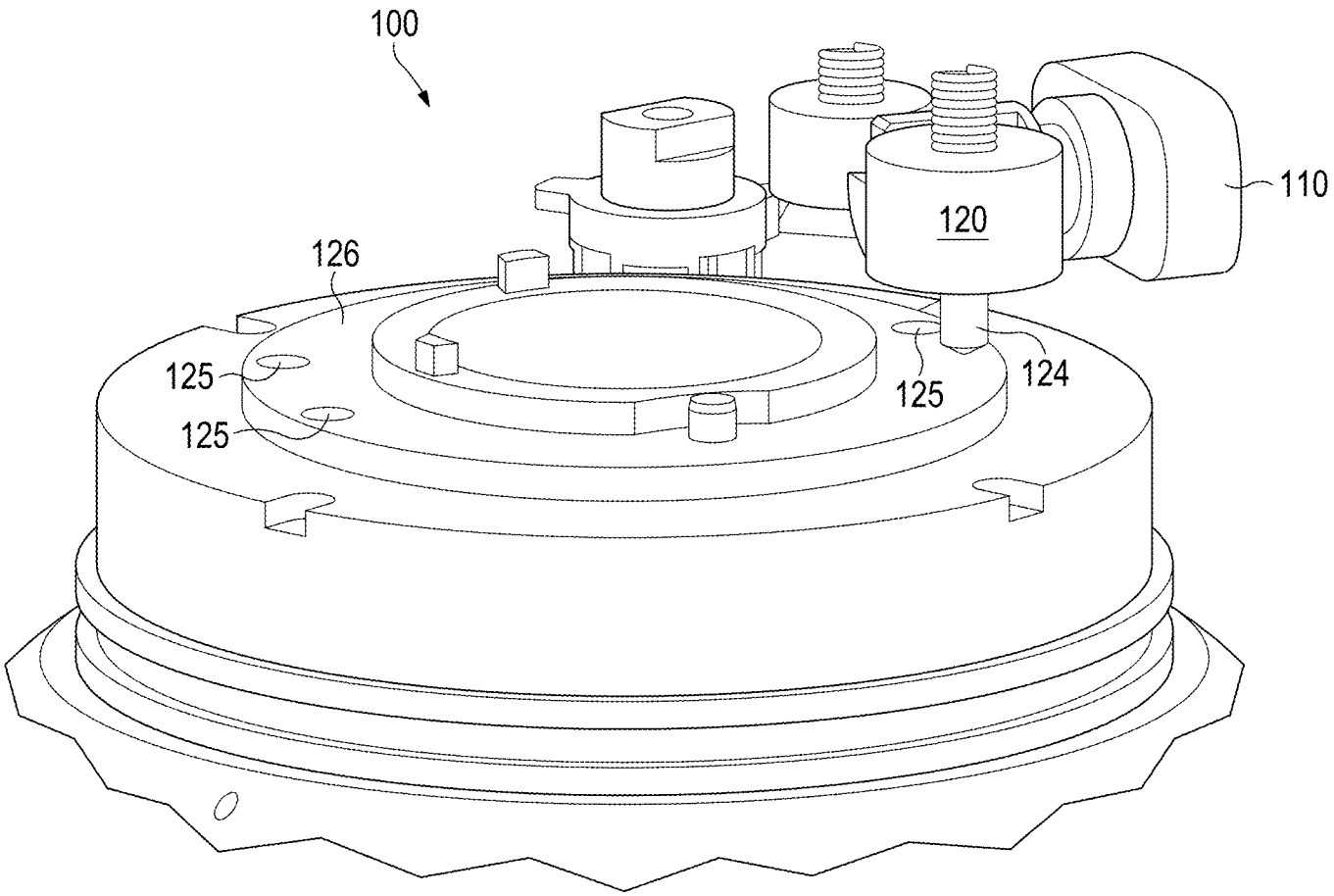
Figure 7A:
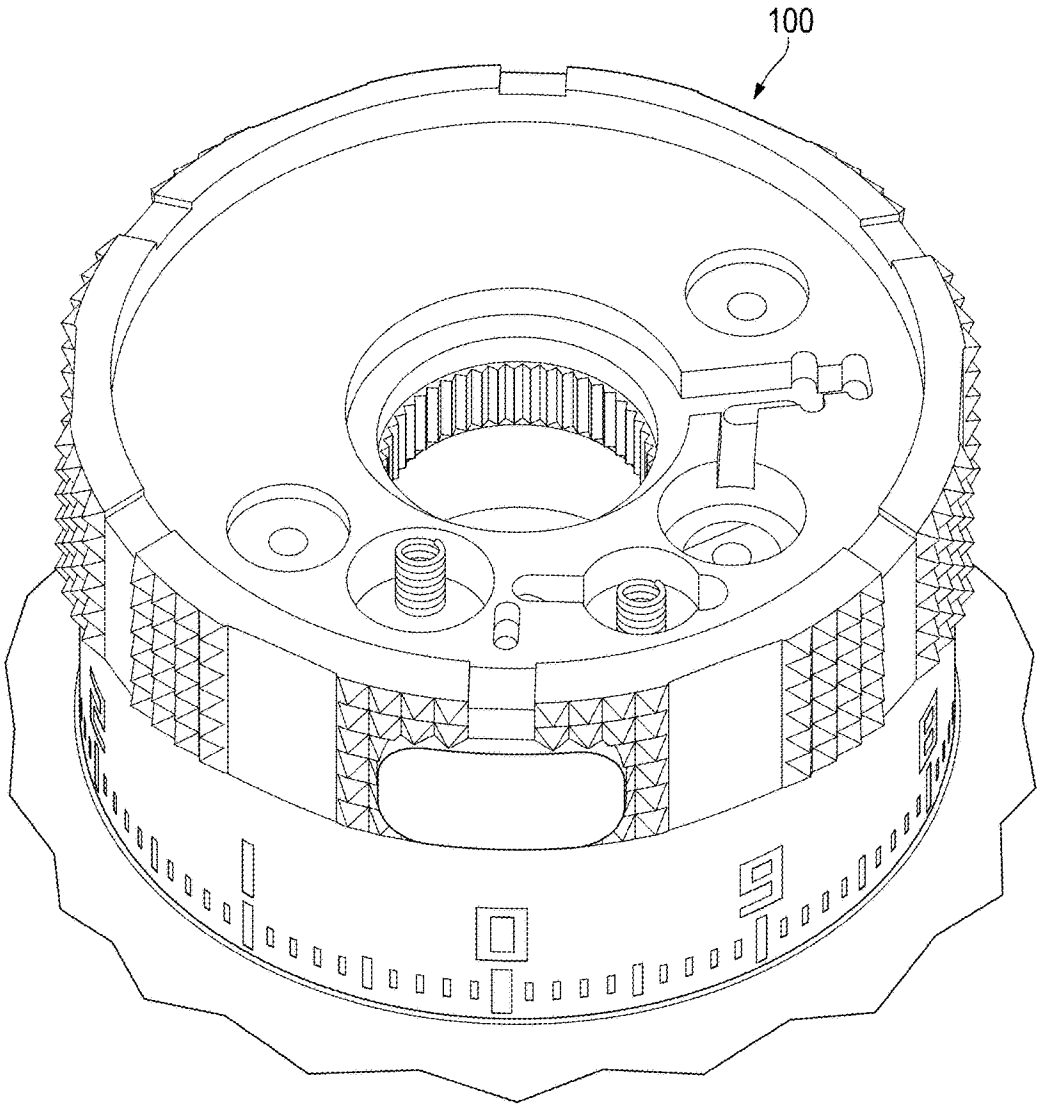
FIGS. 7A, 7B, and 7C are various perspective views illustrating components of the adjustable elevation turret of FIG. 1 in a third positively adjusted, unlocked position according to embodiments of the disclosure.
Figure 7B:
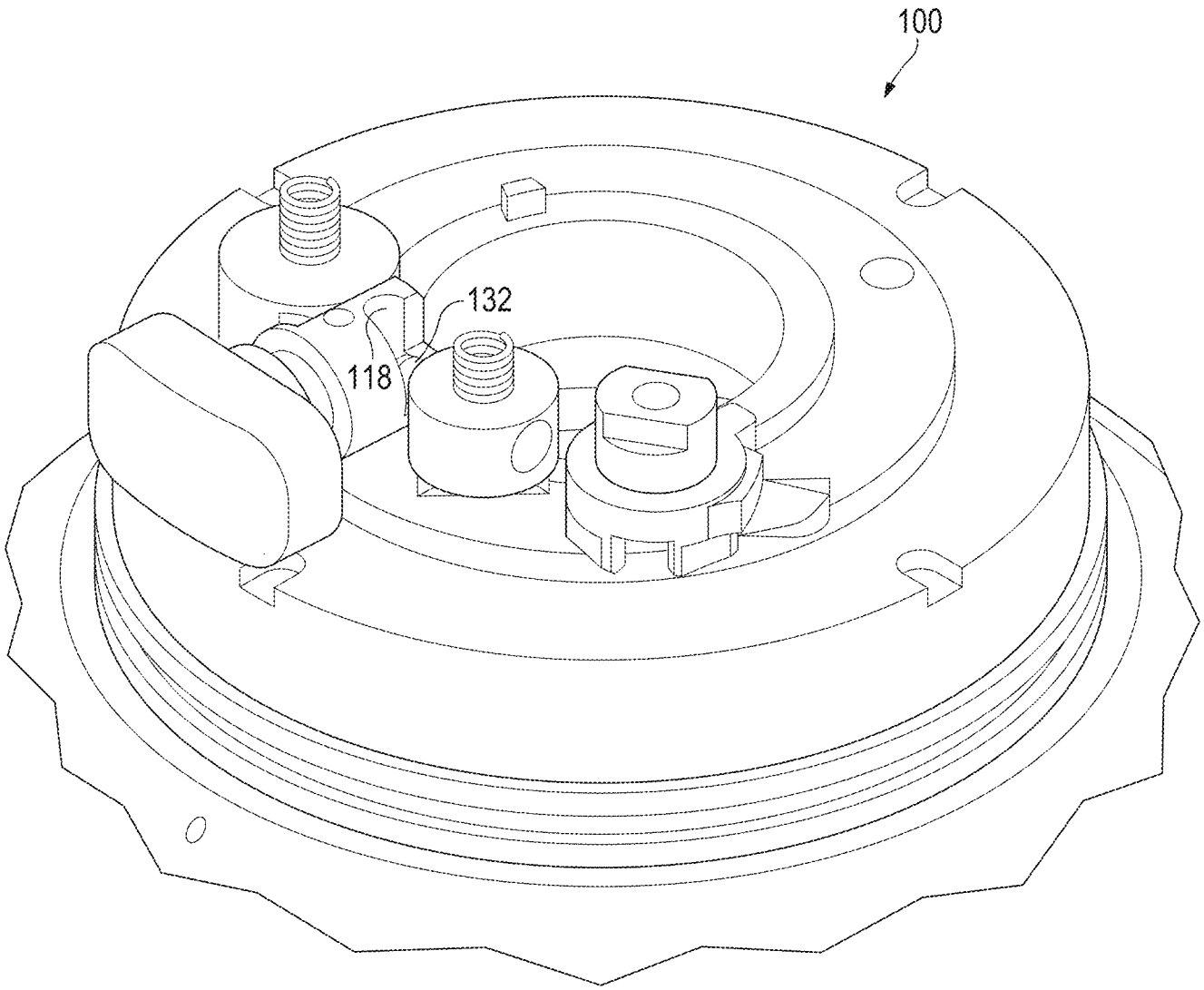
Figure 7C:
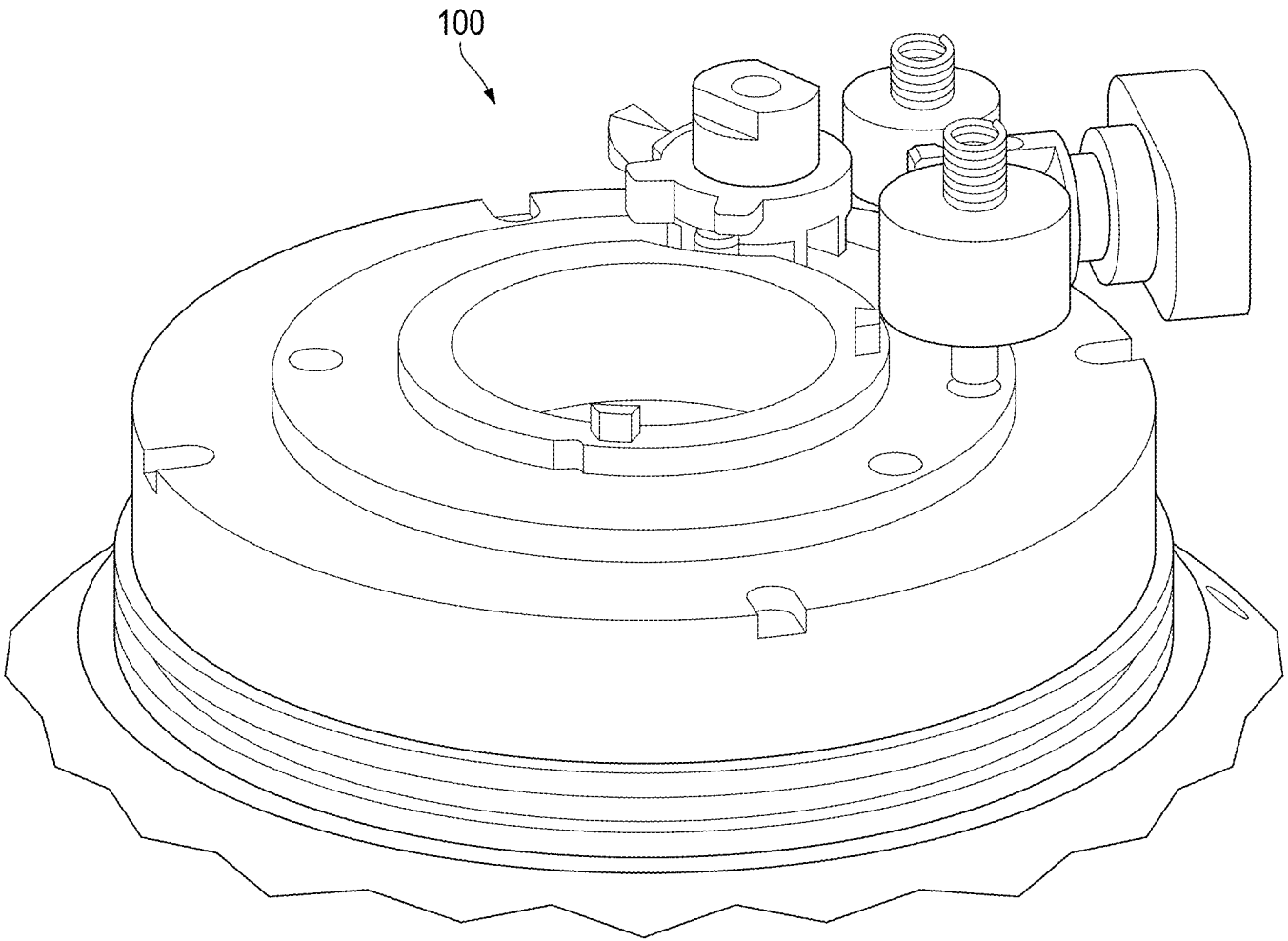
Figure 8A:
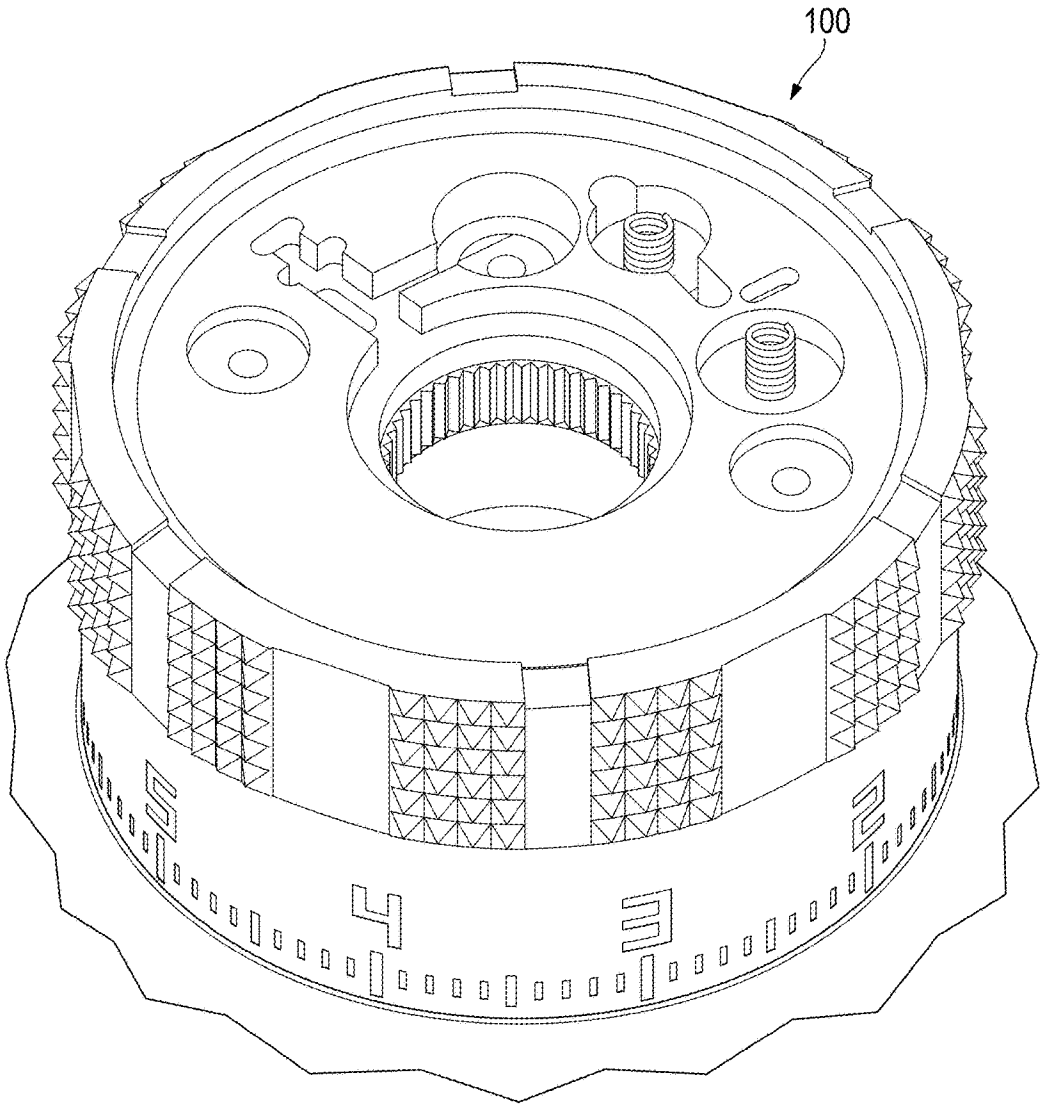
FIGS. 8A, 8B, and 8C are various perspective views illustrating components of the adjustable elevation turret of FIG. 1 in a fourth positively adjusted, unlocked position according to embodiments of the disclosure.
Figure 8B:
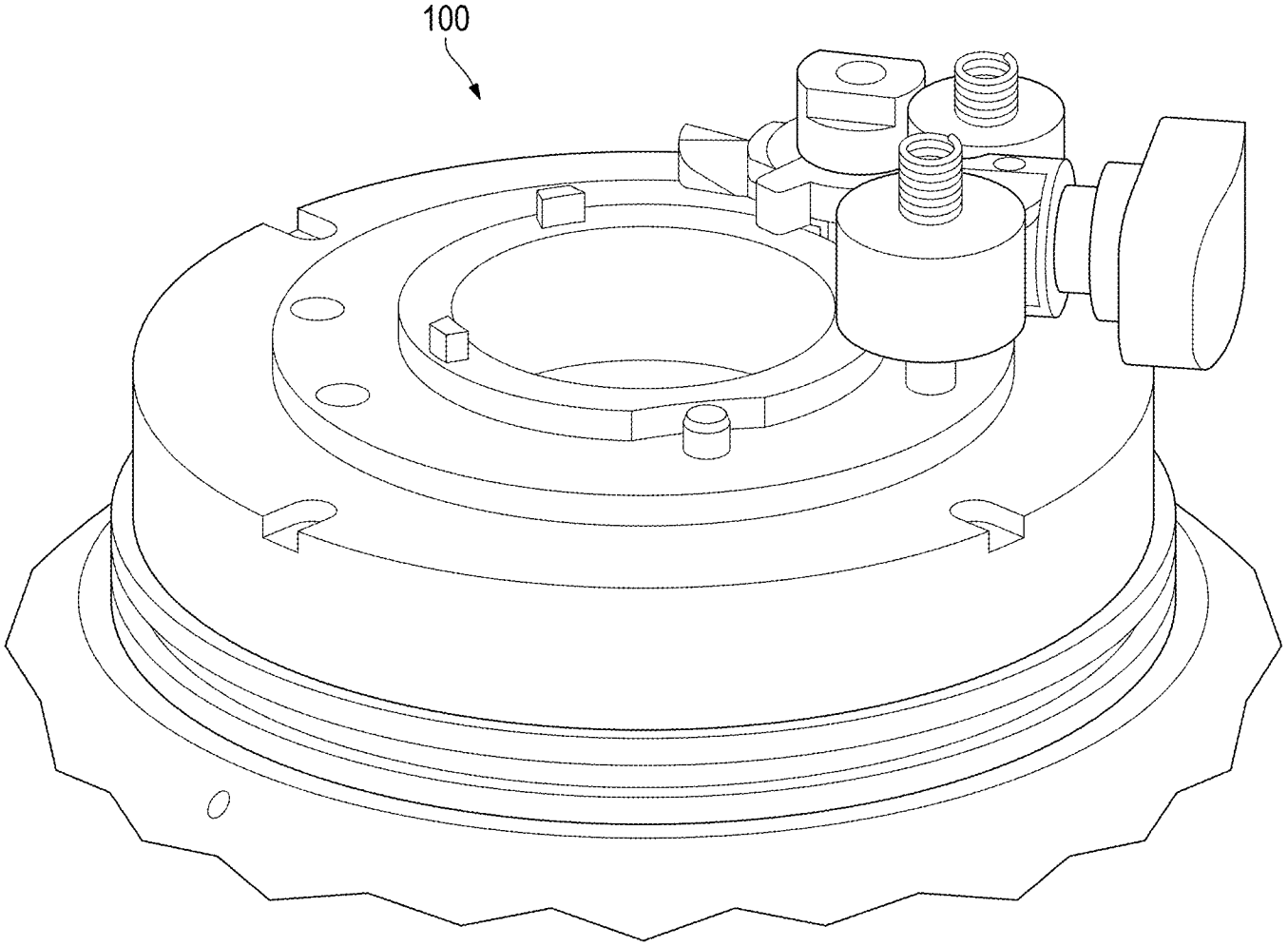
Figure 8C:
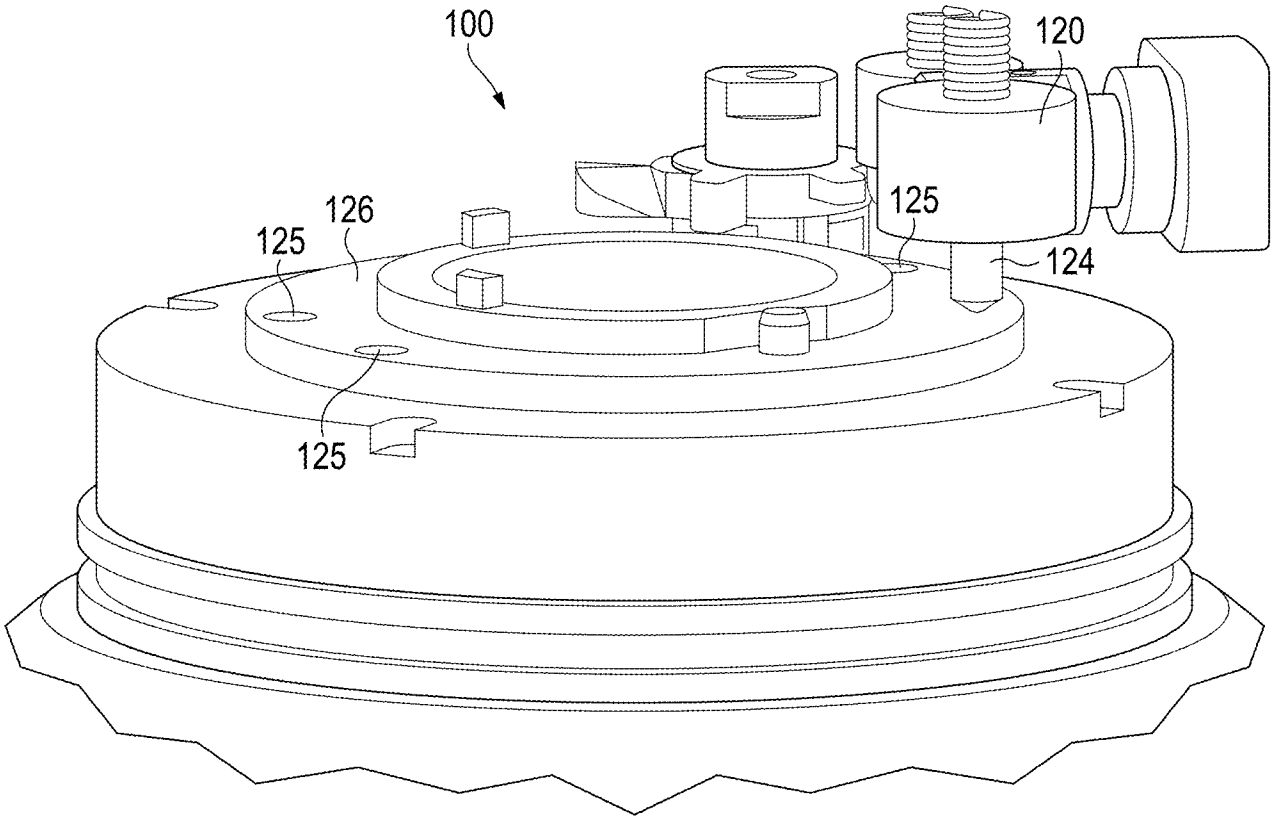

FIGS. 5A-5D illustrate the elevation turret 100 in a first positively adjusted, unlocked position according to embodiments of the disclosure. Specifically, 5D shows that the lock pin 124 is not inserted into any of the locking holes 125 of the lock plate 126. FIGS. 6A-6D, FIGS. 7A-7C, and FIGS. 8A-8C likewise illustrate the elevation turret 100 in second, third, and fourth positively adjusted, unlocked positions according to embodiments of the disclosure. As these are all unlocked positions of the elevation turret 110, the positions of the internal components are all described in the "Unlocked positions" column of Table 1. FIGS. 5C, 6B, and 7B, all illustrate that the retainer pin 132 is captured in the retainer slot 118, which keeps the lock release 110 in the "in" position, which is the unlocked position. FIG. 8C also clearly shows that the locking pin 124 is not inserted into any of the locking holes 125. Since the locking pin 124 is free from all of the locking holes 125 in each of these illustrated positions, the dial 104 of the elevation turret 100 is free to rotate, and the elevation turret is in its unlocked state. The main difference between any of these positions illustrated in FIGS. 5A-8C is the rotational position of the pawl 140. In each of these illustrated orientations, none of the tabs 142, 144, 146 of the pawl 140 is in contact with the retainer 130, meaning that the retainer is kept in its lowered position by operation of the retainer spring 131. FIGS. 5C, 6B, 7B, and 8C each illustrate how the pawl 140 is rotated in different amounts in each of these positions.

Figure 9A:
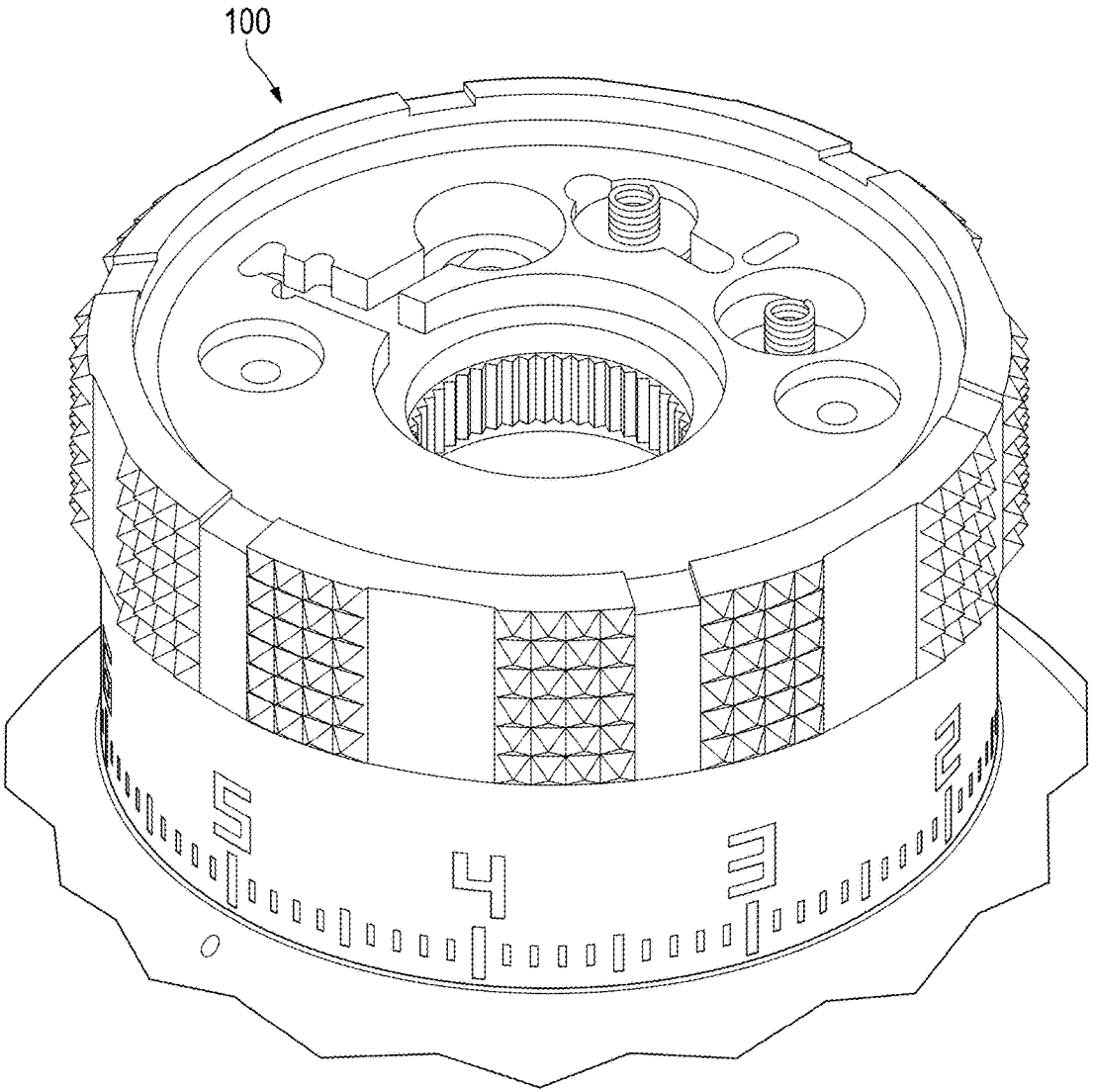
FIGS. 9A, 9B, 9C, and 9D are various perspective views illustrating components of the adjustable elevation turret of FIG. 1 in a positively adjusted, locked position at the positive end of travel of the adjustable elevation turret, according to embodiments of the disclosure.
Figure 9B:
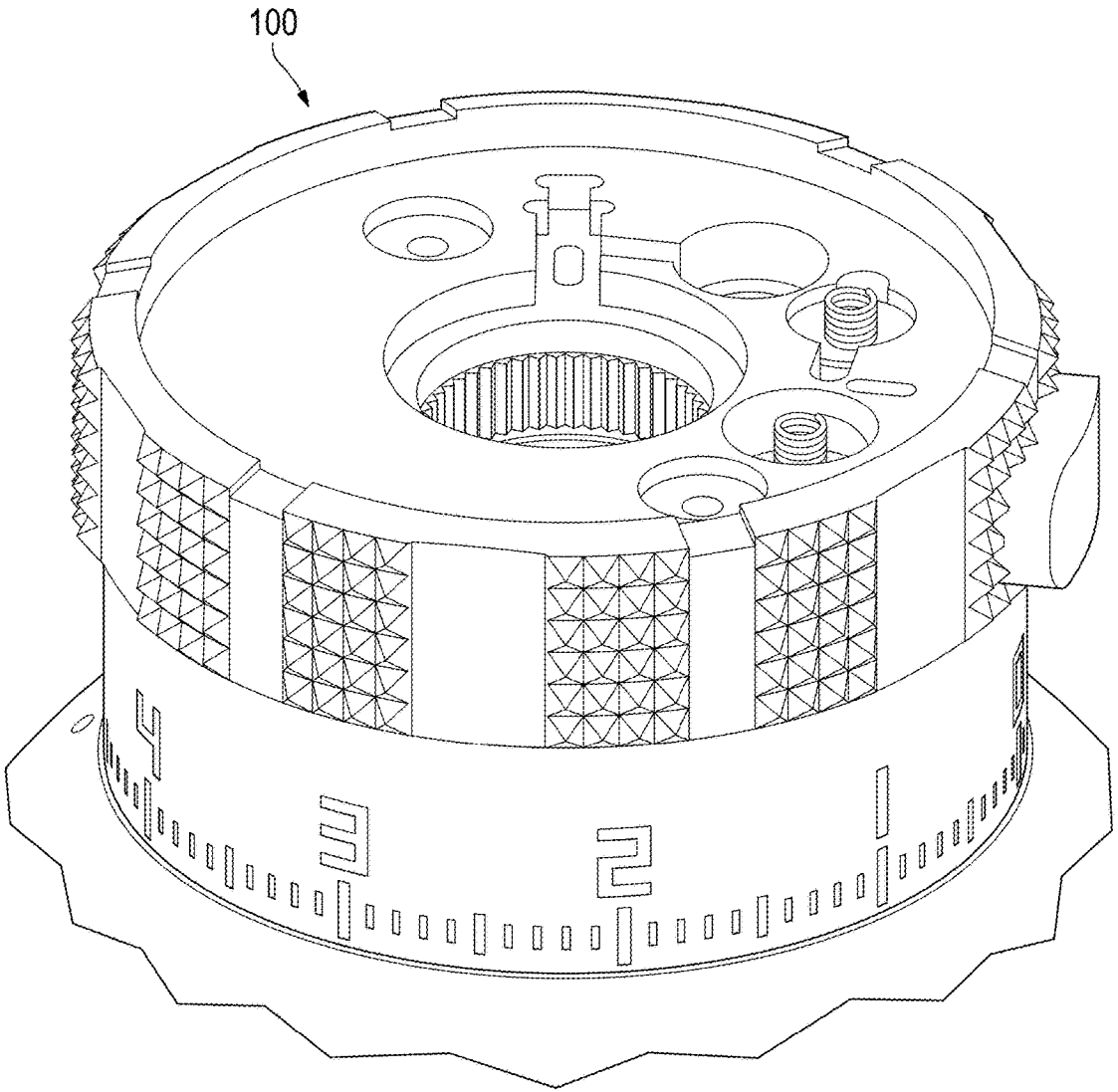
Figure 9C:
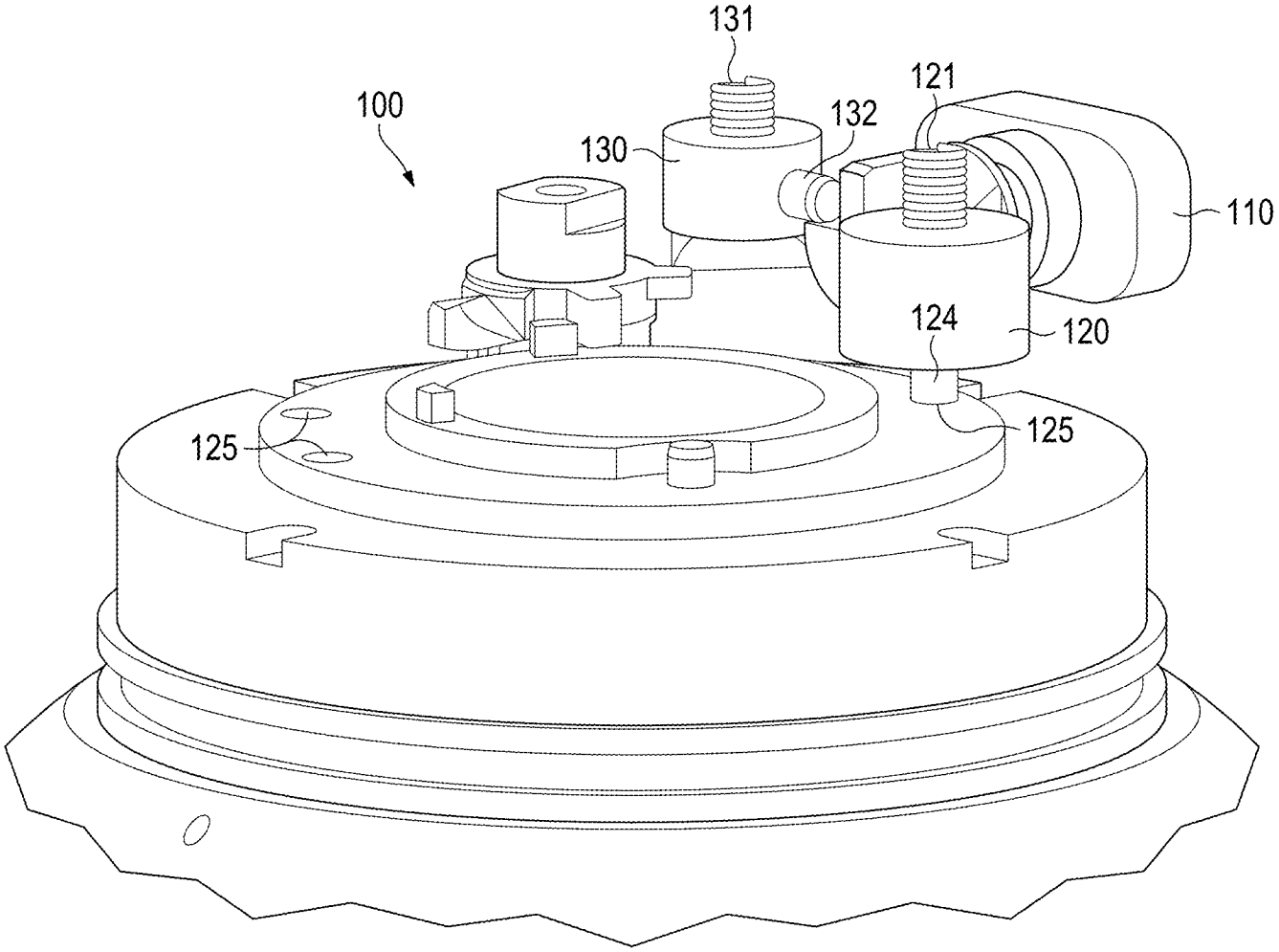
Figure 9D:
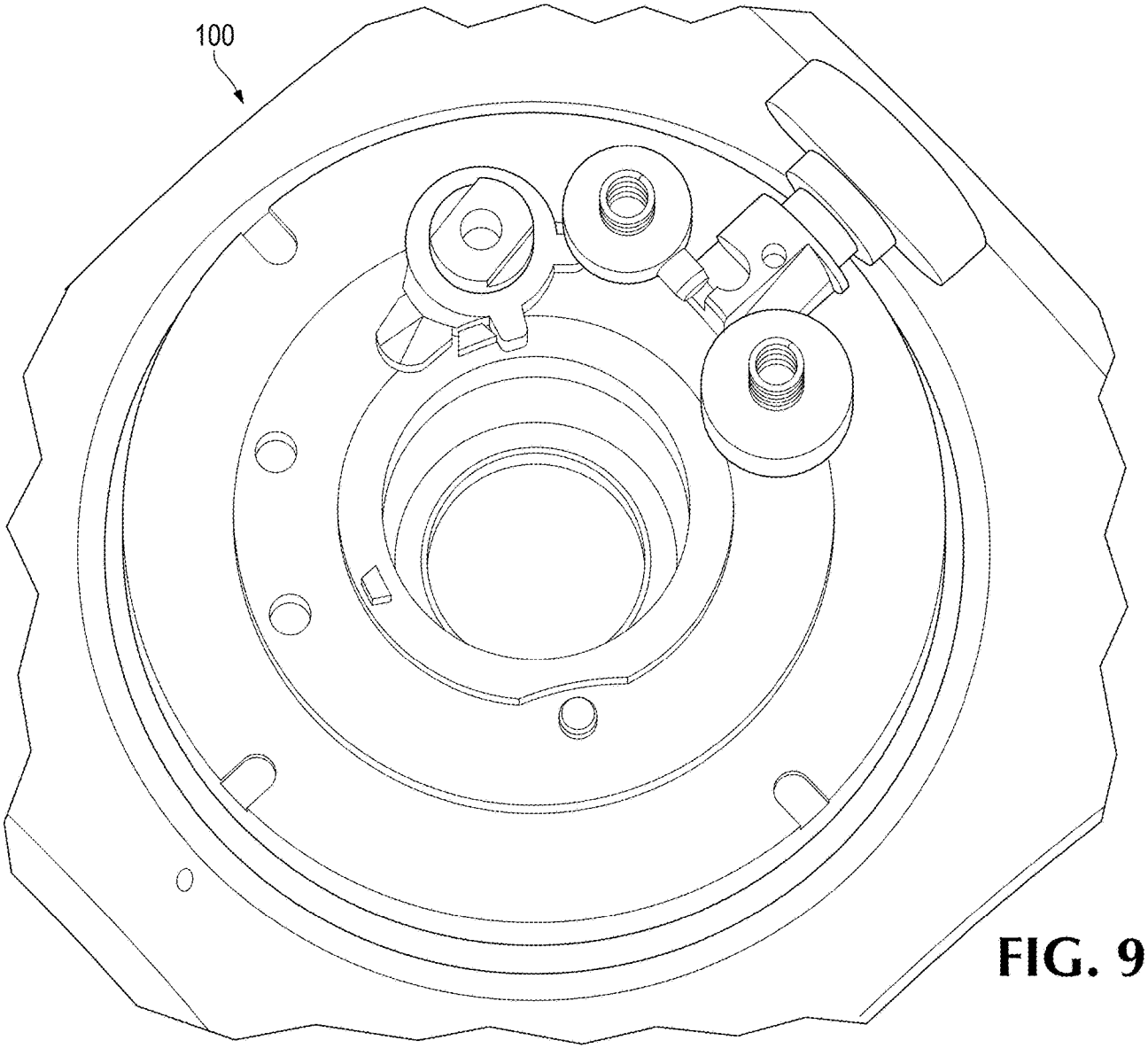

Finally, FIGS. 9A-9D are various perspective views illustrating components of the adjustable elevation turret 100 in a positively adjusted, locked position at the positive end of travel of the adjustable elevation turret 100, according to embodiments of the disclosure. This orientation is described in the "Lock position 3" column of Table 1. FIG. 9B illustrates that the lock release 110 is in its outward, locked position. FIG. 9D shows that the retainer pin 132 is raised out of the retaining slot 118. FIG. 9C illustrates that the locking pin 124 is inserted into one of the locking holes 125, thereby preventing rotation of the elevation turret 100. Further, FIG. 9D illustrates that the tab 146 is in contact with and raises up retainer 130, which is what caused the lifting pin 132 to be raised out of the retaining slot 118, and allows the lock release 110 to return to its outward, locked, position.

Figure 10:
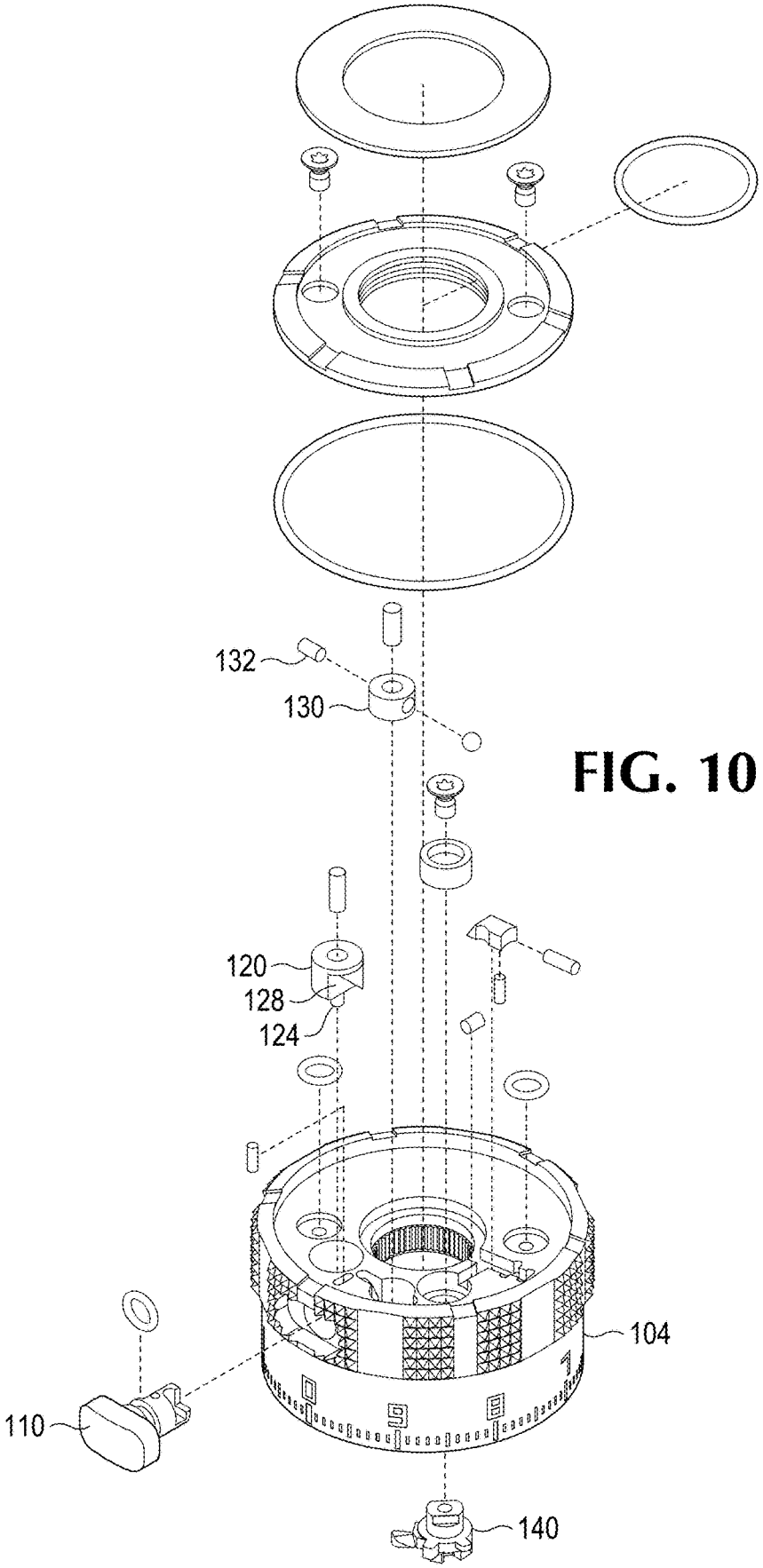
FIG. 10 is an exploded view of the adjustable elevation turret of FIG. 1 illustrating individual components thereof, according to embodiments of the disclosure.

FIG. 10 is an exploded view of components of the adjustable elevation turret 100 according to embodiments of the invention. Many of the components of the elevation turret 100 are not specifically labeled in FIG. 10 so as not to obscure inventive concepts.

The aspects of the present disclosure are susceptible to various modifications and alternative forms. Specific aspects have been shown by way of example in the drawings and are described in detail herein. However, one should note that the examples disclosed herein are presented for the purposes of clarity of discussion and are not intended to limit the scope of the general concepts disclosed to the specific aspects described herein unless expressly limited. As such, the present disclosure is intended to cover all modifications, equivalents, and alternatives of the described aspects in light of the attached drawings and claims.

Specifically, the locking function of the design illustrated above is described with reference to a locking pin 124 being inserted into a locking hole 125, but the pin and hole shapes are not the only shapes that can affect the locking function. Instead, any cooperating or interfering structures between two rotatable parts may be used as the lock. The locking pin 124 may take any cross-sectional shape instead of the circular shape illustrated above, such as oval, rectangular, square, or any polygon shape. Also, the relative sizes of the locking pin 124 to the lock 120 may be different, such as much larger, smaller, longer, etc. Any of the locking holes 125 may be receivers or apertures shaped to accept or receive any shape of the locking pin 125.

References in the specification to aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described in connection with a particular aspect, such feature, structure, or characteristic can be employed in connection with another disclosed aspect whether or not such feature is explicitly described in conjunction with such other disclosed aspect.

Additionally, this written description makes reference to particular features. It is to be understood that the disclosure in this specification includes all possible combinations of those particular features. For example, where a particular feature is disclosed in the context of a particular aspect, that feature can also be used, to the extent possible, in the context of other aspects.

Also, when reference is made in this application to a method having two or more defined steps or operations, the defined steps or operations can be carried out in any order or simultaneously, unless the context excludes those possibilities.

Although specific aspects of the disclosure have been illustrated and described for purposes of illustration, it will be understood that various modifications may be made without departing from the spirit and scope of the disclosure.

EXAMPLES

The previously described versions of the disclosed subject matter have many advantages that were either described or would be apparent to a person of ordinary skill. Even so, these advantages or features are not required in all versions of the disclosed apparatus, systems, or methods.

Example 1 is a locking adjustment turret coupled to an optic of an aiming device, the locking adjustment including a locking plate having two or more locking holes, a dial configured to rotate about a central axis of the locking adjustment turret when a user applies a rotational force, a locking pin attached to the dial, the locking pin structured to interface with the locking plate and be received within an aligned one of the two or more holes of the locking plate when the locking pin is aligned with the aligned hole to set the locking adjustment turret in a locked position, a biasing spring for biasing the locking pin toward the locking plate, and a lock release carried by dial, the lock release configured to move radially inward when pressed by a user to cause the locking pin to move out of the aligned hole and set the adjustment turret in an unlocked position.

Example 2 is a locking adjustment turret according to Example 1, in which the lock release includes a ramp structured to interface with a complementary locking ramp coupled to the locking pin and to cause the locking pin to be moved out of its received position in the aligned one of the two or more holes of the locking plate when the lock release is pressed by a user.

Example 3 is a locking adjustment turret according to Example 2, in which the complementary locking ramp is structured to act upon the lock release ramp and force the lock release radially outward when the locking pin is received in another aligned one of the two or more holes of the locking plate.

Example 4 is a locking adjustment turret according to any of the preceding Examples, further comprising a retainer configured to maintain the lock release in its radially inward position and keep the locking adjustment turret in the unlocked position until the dial is rotated to a rotational position in which the locking pin is aligned with another of the two or more holes of the locking plate.

Example 5 is a locking adjustment turret according to Example 4, in which the retainer comprises a retaining pin structured to be retained in a retaining slot of the lock release when the locking adjustment turret is in the unlocked position.

Example 6 is a locking adjustment turret according to preceding Examples 4 and 5, further comprising a pawl mechanism having a pawl structured to interface with the retainer and to control a vertical position of the retainer relative to the lock release.

Example 7 is a locking adjustment turret according to any of the preceding Examples, in which the locking plate includes three holes.

Example 8 is a locking adjustment turret according to Example 7, in which the three holes of the locking plate are disposed within the locking plate to allow the locking adjustment turret to lock in a −1 mrad position, a zero mrad position, and a 25 mrad position.

Example 9 is a riflescope including an elongated housing, an optic disposed within the housing for aiming the riflescope at a desired target, and a locking adjustment turret coupled to the optic, the locking adjustment turret including a locking plate having two or more locking apertures, a dial configured to rotate about a central axis of the locking adjustment turret when a user applies a rotational force, a locking element carried by the dial, the locking element structured to interface with the locking plate and be received within an aligned one of the two or more locking apertures of the locking plate when the locking element is aligned with the aligned aperture to set the locking adjustment turret in a locked position, a biasing spring for biasing the locking element toward the locking plate, and a lock release carried by dial, the lock release configured to move radially inward when pressed by a user to cause the locking element to disengage from the aligned aperture and set the adjustment turret in an unlocked position.

Example 10 is a riflescope according to Example 9, in which the lock release includes a ramp structured to interface with a complementary locking ramp coupled to the locking element and to cause the locking element to be moved out of its received position in the aligned one of the two or more apertures of the locking plate when the lock release is pressed by a user.

Example 11 is a riflescope according to preceding Examples 9 and 10, in which the complementary locking ramp is structured to act upon the lock release ramp and force the lock release radially outward when the locking element is received in another aligned one of the two or more apertures of the locking plate.

Example 12 is a riflescope according to any of the preceding Examples 9-11, further comprising a retainer configured to maintain the lock release in its radially inward position and keep the locking adjustment turret in the unlocked position until the dial is rotated to a rotational position in which the locking pin is aligned with another of the two or more apertures of the locking plate.

Example 13 is a riflescope according to Example 12, in which the retainer comprises a retaining pin structured to be retained in a retaining slot of the lock release when the locking adjustment turret is in the unlocked position.

Example 14 is a riflescope according to Example 12, further comprising a pawl mechanism having a pawl structured to interface with the retainer and to control a vertical position of the retainer relative to the lock release.

Example 15 is a method of controllably locking an elevation turret of a riflescope, the method including carrying a locking pin in a dial of the elevation turret as the dial rotates about a center axis of the elevation turret, causing the locking pin to vertically separate from a stationary locking plate when a lock release is controlled by a user from a beginning position to a secondary position to cause the elevation turret to be in an unlocked state, and preventing the lock release from returning to its beginning position when the elevation turret is in the unlocked state.

Example 16 is a method according to Example 15, further including forcing the locking pin into an aperture of the locking plate when the locking pin is vertically aligned with the aperture of the locking plate based on a rotation of the dial.

Example 17 is a method according to Examples 15 and 16, further comprising allowing the lock release to return to its beginning position when the locking pin is vertically aligned with the aperture of the locking plate.

Example 18 is a method according to Examples 16 or 17, in which preventing the lock release from returning to its beginning position is controlled by a vertical position a retainer.

Example 19 is a method according to Example 18, further comprising controlling the vertical position of the retainer by action of a pawl that rotates as the dial is rotated.

Example 20 is a method according to any of the preceding Example Methods 15-19 in which causing the locking pin to vertically separate from the stationary locking plate includes engaging a first ramp coupled to the lock release with a complimentary ramp coupled to the locking pin, and translating horizontal movement of the lock release provided by the user into vertical movement of the locking pin based on the first ramp and the complimentary ramp sliding past one another.

All features disclosed in the specification, including the description as well as the drawings, and all the steps in any method or process disclosed, may be combined in any combination, except combinations where at least some of such features and/or steps are mutually exclusive. Each feature disclosed in the specification, including the drawings, can be replaced by alternative features serving the same, equivalent, or similar purpose, unless expressly stated otherwise.

Although specific examples of the invention have been illustrated and described for purposes of illustration, it will be understood that various modifications may be made without departing from the spirit and scope of the invention. Accordingly, the invention should not be limited except as by the appended claims.

We claim:

1. A locking adjustment turret coupled to an optic of an aiming device, the locking adjustment turret comprising:

a locking plate having two or more locking holes;

a dial configured to rotate about a central axis of the locking adjustment turret when a user applies a rotational force;

a locking pin attached to the dial, the locking pin structured to interface with the locking plate and be received within an aligned one of the two or more holes of the locking plate when the locking pin is aligned with the aligned hole to set the locking adjustment turret in a locked position;

a biasing spring for biasing the locking pin toward the locking plate; and a lock release carried by dial, the lock release configured to move radially inward when pressed by a user to cause the locking pin to move out of the aligned hole and set the adjustment turret in an unlocked position.

2. The locking adjustment turret according to claim 1, in which the lock release includes a ramp structured to interface with a complementary locking ramp coupled to the locking pin and to cause the locking pin to be moved out of its received position in the aligned one of the two or more holes of the locking plate when the lock release is pressed by a user.

3. The locking adjustment turret according to claim 2, in which the complementary locking ramp is structured to act upon the lock release ramp and force the lock release radially outward when the locking pin is received in another aligned one of the two or more holes of the locking plate.

4. The locking adjustment turret according to claim 2, further comprising a retainer configured to maintain the lock release in its radially inward position and keep the locking adjustment turret in the unlocked position until the dial is rotated to a rotational position in which the locking pin is aligned with another of the two or more holes of the locking plate.

5. The locking adjustment turret according to claim 4, in which the retainer comprises a retaining pin structured to be retained in a retaining slot of the lock release when the locking adjustment turret is in the unlocked position.

6. The locking adjustment turret according to claim 4, further comprising a pawl mechanism having a pawl structured to interface with the retainer and to control a vertical position of the retainer relative to the lock release.

7. The locking adjustment turret according to claim 1 in which the locking plate includes three holes.

8. The locking adjustment turret according to claim 7 in which the three holes of the locking plate are disposed within the locking plate to allow the locking adjustment turret to lock in a −1 mrad position, a zero mrad position, and a 25 mrad position.

9. A riflescope, comprising:

an elongated housing;

an optic disposed within the housing for aiming the riflescope at a desired target; and a locking adjustment turret coupled to the optic, the locking adjustment turret including:

a locking plate having two or more locking apertures, a dial configured to rotate about a central axis of the locking adjustment turret when a user applies a rotational force, a locking element carried by the dial, the locking element structured to interface with the locking plate and be received within an aligned one of the two or more locking apertures of the locking plate when the locking element is aligned with the aligned aperture to set the locking adjustment turret in a locked position, a biasing spring for biasing the locking element toward the locking plate, and a lock release carried by dial, the lock release configured to move radially inward when pressed by a user to cause the locking element to disengage from the aligned aperture and set the adjustment turret in an unlocked position.

10. The riflescope according to claim 9, in which the lock release includes a ramp structured to interface with a complementary locking ramp coupled to the locking element and to cause the locking element to be moved out of its received position in the aligned one of the two or more apertures of the locking plate when the lock release is pressed by a user.

11. The riflescope according to claim 9, in which the complementary locking ramp is structured to act upon the lock release ramp and force the lock release radially outward when the locking element is received in another aligned one of the two or more apertures of the locking plate.

12. The riflescope according to claim 9, further comprising a retainer configured to maintain the lock release in its radially inward position and keep the locking adjustment turret in the unlocked position until the dial is rotated to a rotational position in which the locking pin is aligned with another of the two or more apertures of the locking plate.

13. The riflescope according to claim 12, in which the retainer comprises a retaining pin structured to be retained in a retaining slot of the lock release when the locking adjustment turret is in the unlocked position.

14. The riflescope according to claim 12, further comprising a pawl mechanism having a pawl structured to interface with the retainer and to control a vertical position of the retainer relative to the lock release.

15. A method of controllably locking an elevation turret of a riflescope, the method comprising:

carrying a locking pin in a dial of the elevation turret as the dial rotates about a center axis of the elevation turret;

causing the locking pin to vertically separate from a stationary locking plate when a lock release is controlled by a user from a beginning position to a secondary position to cause the elevation turret to be in an unlocked state; and preventing the lock release from returning to its beginning position when the elevation turret is in the unlocked state.

16. The method according to claim 15, further comprising:

forcing the locking pin into an aperture of the locking plate when the locking pin is vertically aligned with the aperture of the locking plate based on a rotation of the dial.

17. The method according to claim 16, further comprising allowing the lock release to return to its beginning position when the locking pin is vertically aligned with the aperture of the locking plate.

18. The method according to claim 16, in which preventing the lock release from returning to its beginning position is controlled by a vertical position a retainer.

19. The method according to claim 18, further comprising controlling the vertical position of the retainer by action of a pawl that rotates as the dial is rotated.

20. The method according to claim 15 in which causing the locking pin to vertically separate from the stationary locking plate comprises:

engaging a first ramp coupled to the lock release with a complimentary ramp coupled to the locking pin; and translating horizontal movement of the lock release provided by the user into vertical movement of the locking pin based on the first ramp and the complimentary ramp sliding past one another.

* * * * *